US006329135B1

(12) United States Patent
Kashiwagi

(10) Patent No.: US 6,329,135 B1
(45) Date of Patent: Dec. 11, 2001

(54) SILVER HALIDE PHOTOTHERMOGRAPHIC MATERIAL

(75) Inventor: Hiroshi Kashiwagi, Hino (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 09/586,496

(22) Filed: Jun. 2, 2000

(30) Foreign Application Priority Data

Jun. 3, 1999 (JP) ..... 11-156335

(51) Int. Cl.[7] ..... G03C 1/498; G03C 1/34; G03C 1/12

(52) U.S. Cl. ..... 430/619; 430/577; 430/578; 430/584; 430/588; 430/591; 430/600; 430/613; 430/614; 430/615; 430/944

(58) Field of Search ..... 430/619, 600, 430/613, 614, 615, 578, 591, 577, 944, 584, 588

(56) References Cited

U.S. PATENT DOCUMENTS 5,169,751 * 12/1992 Szucs et al. ..... 430/600
5,529,889 * 6/1996 Ueda et al. ..... 430/353
5,571,664 * 11/1996 Siegel et al. ..... 430/506
5,869,229 * 2/1999 Okada et al. ..... 430/619
6,054,259 * 4/2000 Hioki ..... 430/578
6,132,950 * 10/2000 Ishigaki et al. ..... 430/619

FOREIGN PATENT DOCUMENTS 0798129 1/1997 (EP) .
6230507 8/1994 (JP) .
10-186572 7/1998 (JP) .
11-2880 1/1999 (JP) .

OTHER PUBLICATIONS

European Search Report EP 00 11 1693.
XP 000073364, 244 Research Disclosure (1989) Mar., No. 299, New York, N.Y. U.S.

* cited by examiner

*Primary Examiner*—Thorl Chea
(74) *Attorney, Agent, or Firm*—Jordan B. Bierman; Bierman, Muserlian and Lucas

(57) ABSTRACT

A silver halide photothermographic material is disclosed, comprising a support having thereon a light-sensitive layer and light-insensitive layer, wherein the light-sensitive layer or the light-insensitive layer comprises a heteroatom-containing macrocyclic compound, and the light-sensitive layer comprising a sensitizing dye exhibiting maximum sensitivity at a wavelength of 600 nm or more.

16 Claims, No Drawings

SILVER HALIDE PHOTOTHERMOGRAPHIC MATERIAL

FIELD OF THE INVENTION

The present invention relates to thermally developable silver halide photothermographic materials, and an image recording method and image forming method by use thereof, and in particular spectrally sensitized silver halide photothermographic materials exhibiting enhanced sensitivity, reduced variation in sensitivity after pre-exposure storage and improved silver image tone, and an image recording method and an image forming method by use thereof.

BACKGROUND OF THE INVENTION

Spectrally infrared-sensitizing dyes in general are inferior in adsorption to silver halide grains, compared to spectral sensitizing dyes in the visible region, producing problems such as low sensitivity and marked reduction of sensitivity following storage. As a means for overcoming such problems, JP-A (hereinafter, the term, JP-A means an unexamined and published Japanese Patent Application) discloses a technique of using specified infrared sensitizing dyes in combination with a heteroatom containing macrocyclic compound. However, it is not only insufficient in improving effects but also concerns conventional silver halide photographic materials, and further nothing is described therein with respect to thermally developable photosensitive materials. Further, the preferred silver halide composition is taught to be silver chlorobromide. Therefore, when such techniques are applied to thermally developable silver halide photothermographic materials, problems were produced such as:

(1) insufficient prevention of desorption of sensitizing dyes from silver halide grains during storage of coated film, and (2) sensitizing dyes being easily decomposable, leading to reduced sensitivity and increased fogging.

Accordingly, it is difficult to apply this technique to thermally developable photosensitive materials. Binders used in thermally developable photosensitive materials are different from those used in conventional silver halide photographic materials, and therefore adsorption of spectrally sensitizing dyes used in the thermally developable photosensitive materials are also different from the binder matrix of gelatin in conventional silver halide photographic materials. Therefore, it is necessary to apply a method suitable thereto and to realize that the technique described above is not applicable as such. Although such phenomena are marked in infrared-sensitizing dyes, similar problems are likely produced in sensitizing dyes in the visible region.

On the other hand, the need for infrared-sensitive thermally developable photosensitive materials is strong and thermally developable photosensitive materials improved in defects described above are highly desired.

SUMMARY OF THE INVENTION

Accordingly, it is a first object of the present invention to provide a thermally developable silver halide photothermographic material with enhanced sensitivity and which exhibits reduced desensitization during pre-exposure storage.

It is a second object of the invention to provide a thermally developable silver halide photothermographic material giving images improved in silver image tone., light stability and heat stability.

Further, it is a third object of the invention to provide an image recording method and an image forming method by use of the silver halide photothermographic materials described above.

The above problems can be accomplished by the following items 1. through 8.:

1. A silver halide photothermographic material comprising a support having thereon a light-sensitive layer and light-insensitive layer, wherein the light-sensitive layer or the light-insensitive layer comprises a heteroatom-containing macrocyclic compound, and the light-sensitive layer comprises a sensitizing dye exhibiting maximum sensitivity at a wavelength of 600 nm or more;
2. The silver halide photothermographic material described in 1. above, wherein the sensitizing dye is represented by the following formula (1), (2) or (3):

formula (1)

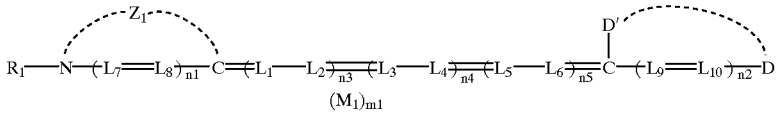

wherein $Z_1$ represents an atomic group necessary to form a 5- or 6-membered nitrogen-containing heterocyclic ring; D and D' each represent an atomic group necessary to form an acyclic or cyclic acidic nucleus; $R_1$ represents an alkyl group; $L_1$, $L_2$, $L_3$, $L_4$, $L_5$, $L_6$, $L_7$, $L_8$, $L_9$ and $L_{10}$ each represent a methine group, provided that each may form a ring together with other methine group(s) or with an auxochrome; n1, n2, n3, n4 and n5 are each 0 or 1; $M_1$ represents a counter ion necessary to neutralize-charge; and m1 is the number of 0 or more, which is necessary to counterbalance intramolecular charge, formula (2)

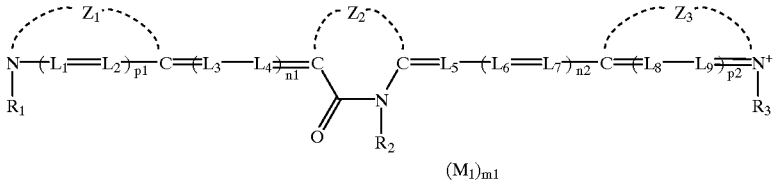

wherein $Z_1$, $Z_2$ and $Z_3$ each represent an atomic group necessary to form a 5- or 6-membered nitrogen-containing heterocyclic ring; $R_1$ and $R_3$ represent an alkyl group; $R_2$ represents a hydrogen atom , an alkyl group, an aryl group or a heterocyclic group; $L_1$, $L_2$, $L_3$, $L_4$, $L_5$, $L_6$, $L_7$, $L_8$, and $L_9$ each represent a methine group; p1 and p2 are each 0 or 1; n1 and n2 are each 0, 1, 2, 3 or 4; $M_1$ represents a charge balancing counter ion; and m1 is the number of 0 or more, which is necessary to counterbalance intramolecular charge, formula (3)

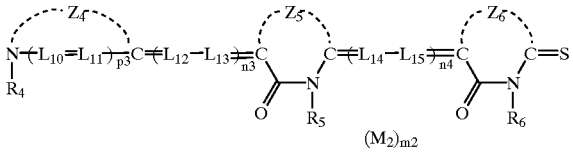

wherein $Z_4$, $Z_5$ and $Z_6$ each represent an atomic group necessary to form a 5- or 6-membered nitrogen-containing heterocyclic ring; $R_4$ represents an alkyl group; $R_5$ and $R_6$ represent a hydrogen atom , an alkyl group, an aryl group or a heterocyclic group; $L_{10}$, $L_{11}$, $L_{12}$, $L_{13}$, $L_{14}$ and $L_{15}$ each represent a methine group; p3 is 0 or 1; n3 and n4 are each 0, 1, 2, 3 or 4; $M_2$ represents a charge balancing counter ion; and m2 is the number of 0 or more, which is necessary to counterbalance intramolecular charge;

3. The silver halide photothermographic material described in 1. above, wherein the sensitizing dye represented by formula (2) is represented by the following formula (4):

formula (4)

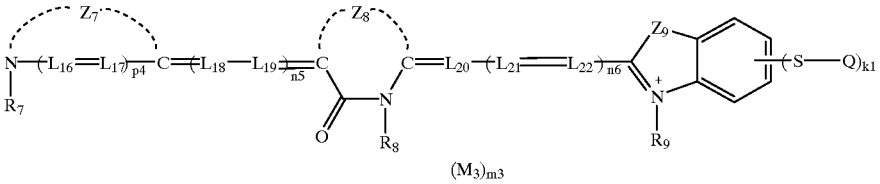

wherein $Z_7$ is the same as defined in $Z_1$ of formula (2), $Z_8$ is the same as defined in $Z_2$ of formula (2) and $Z_9$ represents an oxygen atom, a sulfur atom or a selenium atom; $R_7$ is the same as defined in $R_1$ of formula (2), $R_8$ is the same as defined in $R_2$ of formula (2) and $R_9$ is the same as defined in $R_3$ of formula (2); $L_{16}$ is the same as defined in $L_1$ of formula (2), $L_{17}$ is the same as defined in $L_2$ of formula (2), $L_{18}$ is the same as defined in $L_3$ of formula (2), $L_{19}$ is the same as defined in $L_4$ of formula (2), $L_{20}$ is the same as defined in $L_5$ of formula (2), $L_{21}$ is the same as defined in $L_6$ of formula (2), and $L_{22}$ is the same as defined in $L_7$ of formula (2); p4 is the same as defined in p1 of formula (2); n5 is the same as defined in n1 of formula (2) and n6 is the same as defined in n2 of formula (2); $M_3$ is the same as defined in $M_1$ of formula (2); m3 is the same as defined in m1 of formula (2); Q represents an alkyl group, an aryl group or a heterocyclic group; k1 is 1, 2, 3 or 4;

4. The silver halide photothermographic material described in 1, 2 or 3, wherein light-sensitive silver halide contains overall iodide of 0.01 to 10 mol %;
5. The silver halide photothermographic material described in 1, 2, 3 or 4, wherein binder of the light-sensitive layer is mainly comprised of a polymeric latex;
6. An image recording method, wherein a silver halide photothermographic material described in any one of 1 to 5 above is exposed by using a laser exposure apparatus, in which scanning laser light is not exposed at an angle substantially vertical to the exposed surface of the photothermographic material;
7. The image recording method described in 6, wherein the photothermographic material is exposed by using a laser exposure apparatus, in which scanning laser light is longitudinally multiple;
8. An image forming method, wherein a silver halide photothermographic material is thermally developed in a state having a moisture content of 0.01 to 5.0% by weight.

DETAILED DESCRIPTION OF THE INVENTION

Infrared sensitizing dyes, as described above, are generally weak in adsorption and inferior in storage stability after spectral sensitization of photothermographic materials, producing problems such that sufficient sensitivity is not obtained and desensitization is rather prominent when the photographic materials are stocked. The thermally developable photosensitive material comprises silver halide grains, together with organic silver salt grains, dispersed in a thermosoftening binder, which is more hydrophobic than gelatin (such as polyvinyl butyral). When heated, the organic silver salt is reduced with a reducing agent incorporated into the same layer or an adjacent layer to form images through solution physical development in the heated and softened binder. Accordingly, it is supposed that a sensitizing dye adsorbed to silver halide is apparently disadvantageous for the adsorption equilibrium, as compared to conventional silver halide photographic materials comprising gelatin matrix. To improve these defects, it was attempted that the structure of a spectral-sensitizing dye itself was varied, an infrared sensitizing dye exhibiting strong adsorption, enhanced sensitivity and not so marked desensitization was explored, and a compound promoting adsorption by the combined use with the sensitizing dye, which is effective to enhance sensitivity and improve raw stock stability, was also explored. As a result of these investigations by the inventor of the present invention, it was proved that the use of a heteroatom-containing macrocyclic compound led to improvements in the defects of the thermally developable photosensitive materials, as described above.

The heteroatom-containing macrocyclic compound contained in thermally developable photosensitive materials is more effective when used with an infrared sensitizing dye, leading to enhanced sensitivity and an improvement in desensitization during storage. Specifically, the use in combination with the infrared sensitizing dyes represented by the formulas (1) to (3) described above is furthermore effective. The heteroatom-containing macrocyclic compound refers to a nine- or more-membered macrocyclic compound containing at least a heteroatom selected from a nitrogen atom, an oxygen atom, a sulfur atom and a selenium atom. The macrocyclic compound is preferably a 12- to 24-membered ring and more preferably a 15- to 21-membered ring. Representative compounds thereof include compounds commonly known as a crown ether, which was synthesized by Pederson in 1967 and a number of which have been synthesized since its specific report. The compounds are detailed in C. J. Pederson, Journal of American Chemical Society vol. 86 (2495), 7017–7036 (1967); G. W. Gokel & S. H. Korzeniowski, "Macrocyclic Polyether Synthesis", Springer-Vergal (1982); "Chemistry of Crown Ether" edited by Oda, Shono & Tabuse, published by Kyoritsu Shuppan (1978); "Host-Guest" edited by Tabuse, published by Kyoritsu Shuppan (1979); and Suzuki & Koga, Yuki Gosei Kagaku (Journal of Organic Synthetic Chemistry). vol. 45 (6) 571–582 (1987).

Exemplary examples of the heteroatom containing macrocyclic compounds used in the invention are shown below, but are not limited to these examples.

S-1

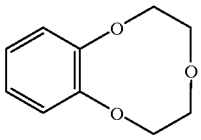

S-2

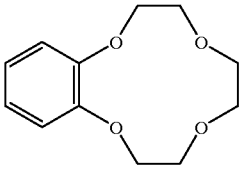

S-3

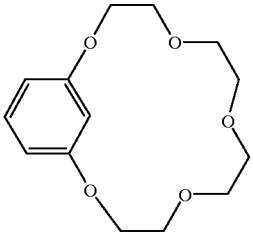

S-4

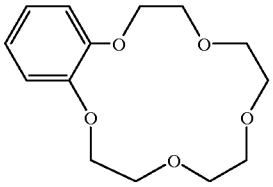

S-5

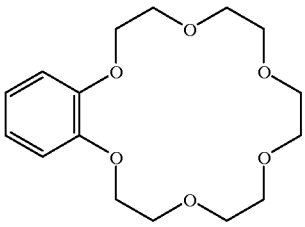

-continued

S-6

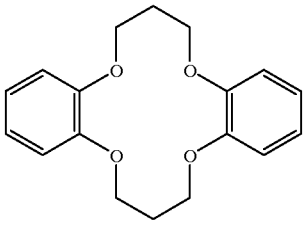

S-7

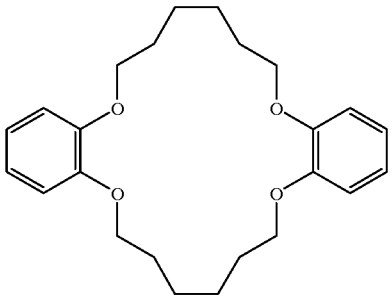

S-8

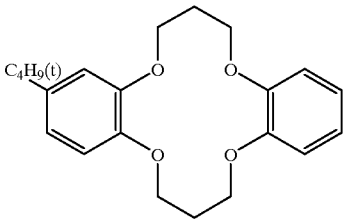

S-9

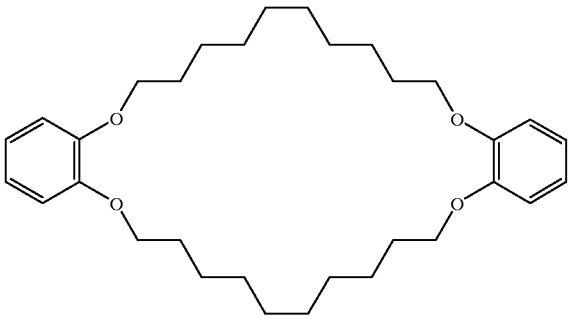

S-10

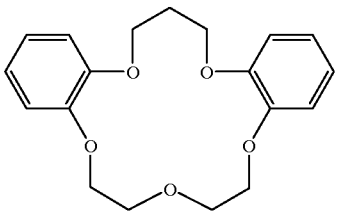

S-11

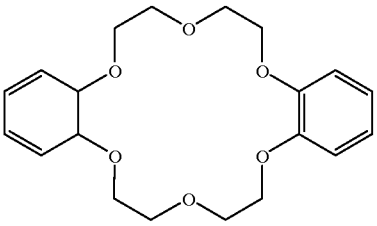

-continued
S-12
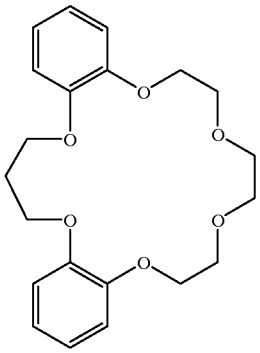
S-13
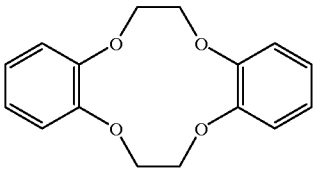
S-14
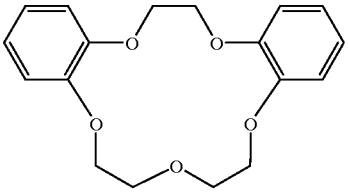
S-15
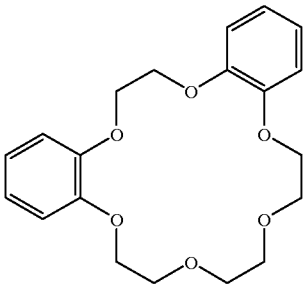
S-16
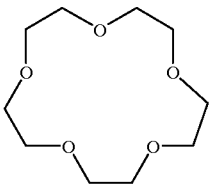
S-17
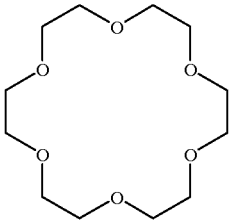
-continued
S-18
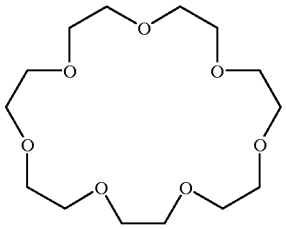
S-19
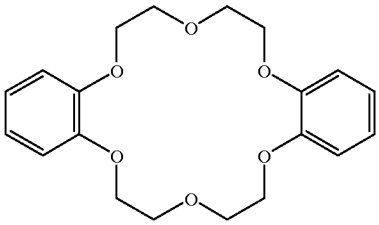
S-20
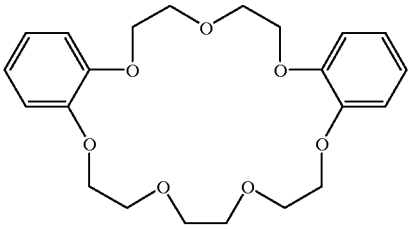
S-21
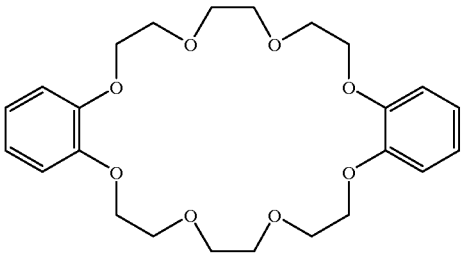
S-22
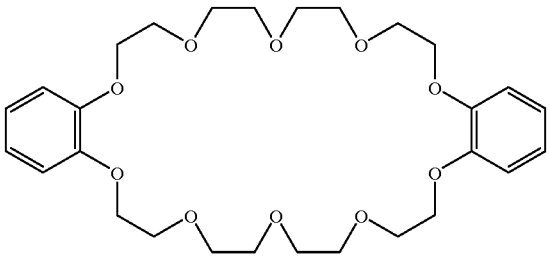
S-23
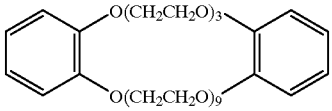
S-24
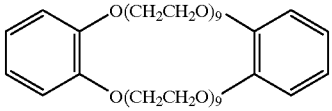

-continued
S-25
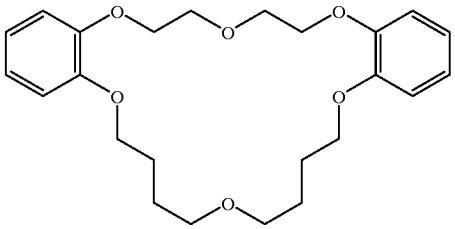
S-26
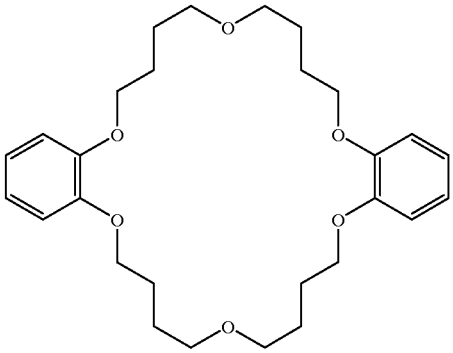
S-27
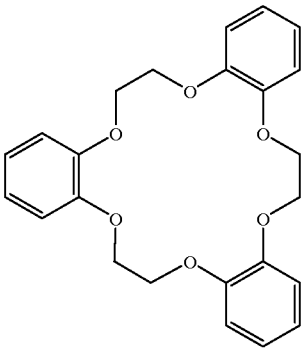
S-28
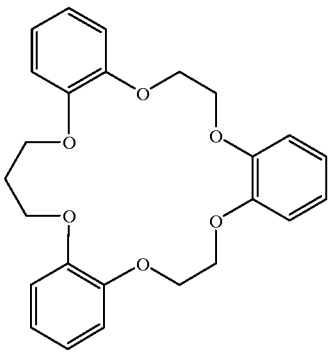
-continued
S-29
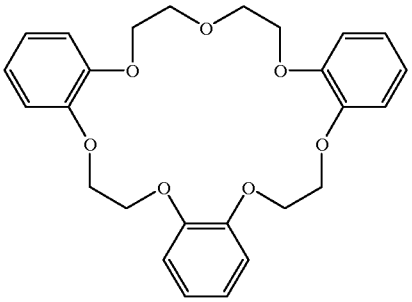
S-30
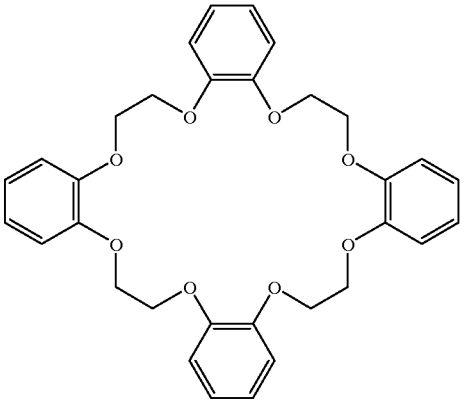
S-31
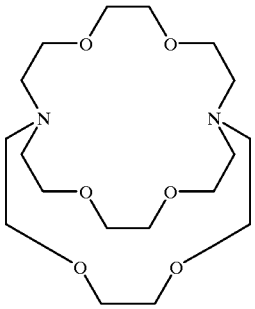
S-32
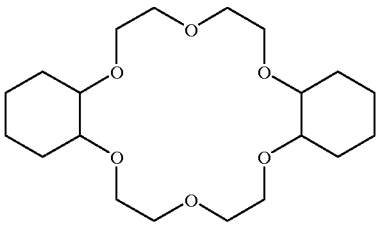
S-33
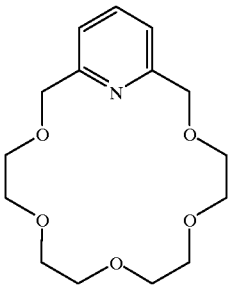

-continued
S-34
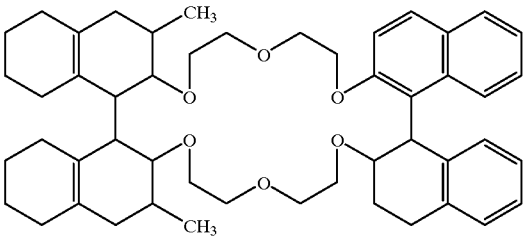
S-35
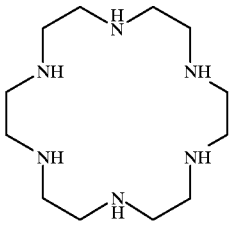
S-36
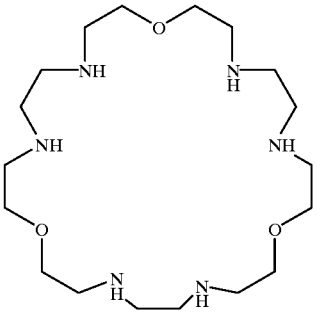
S-37
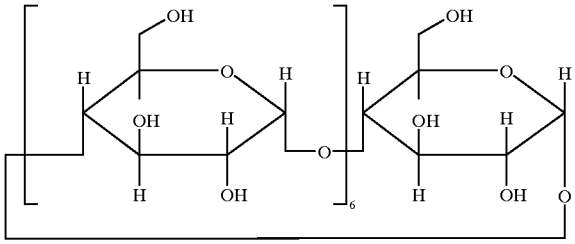
S-38
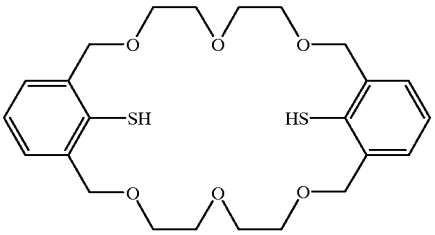
S-39
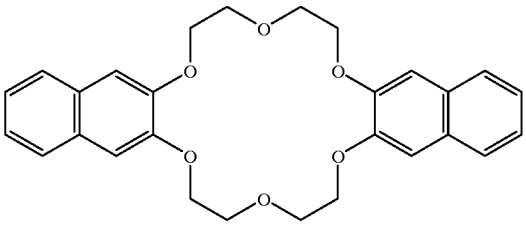
-continued
S-40
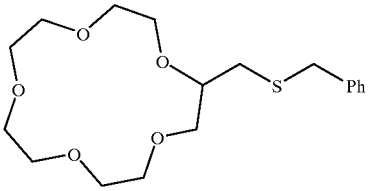
S-41
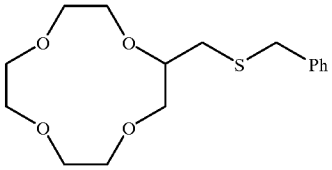
S-42
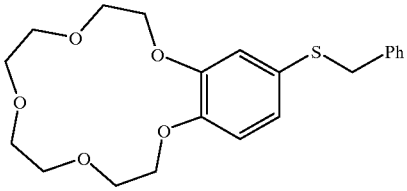
S-43
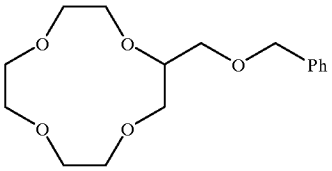
S-44
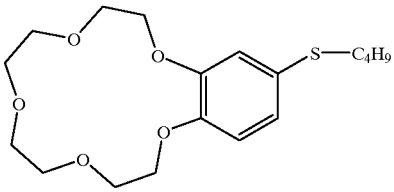
S-45
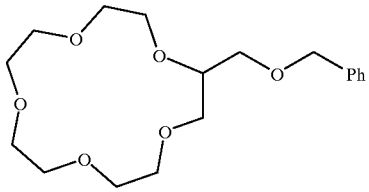
(Ph: phenyl)

Effects of incorporation of these compounds into conventional silver halide photographic materials are described in the literature described above. However, it is surprising that unexpected effects were found even in the thermally developable photosensitive materials, which are entirely different in condition from the conventional silver halide photographic materials. It is not definitely cleared why these compounds exhibited advantageous effects specifically in the thermally developable photographic material Unlike the photosensitive layer of the conventional silver halide photographic material, the thermally developable photosensitive layer contains a silver source other than silver halide (such as organic silver salts or toning agent silver complex salts), so that it is supposed that adsorption of a sensitizing dye to silver halide is easily deteriorated, as compared to the conventional silver halide photographic materials. It is also contemplated that the heteroatom containing macrocyclic compound acts onto it, promoting adsorption of the dye to silver halide.

The heteroatom containing macrocyclic compound may be added at any stage after forming silver halide and until preparing a coating solution, and is added preferably prior to adding the sensitizing dye. To enhance effects of the compound in the thermally developable photosensitive material, as will be described later, it is preferred to introduce an iodide into the region of the surface of silver halide grains used in the thermally developable photosensitive material. It is necessary to further strengthen the adsorption, as compared to conventional systems using gelatin. The heteroatom containing macrocyclic compounds are generally incorporated into the thermally developable photosensitive layer through solution in organic solvents such as methanol, ethanol or fluorinated alcohols, or water. In cases where solubility is not sufficient, dissolution-promoting agent may be used in combination, including potassium acetate, potassium iodide, potassium fluoride, potassium p-toluenesulfonate, $KBF_4$, $KPF_6$, $NH_4BF_4$ and $NH_4PF_6$. Any compound containing an ion capable of forming an inclusion compound together with the heteroatom containing macrocyclic compound, which is able to improve solubility may be usable as the dissolution-promoting agent.

A silver halide photothermographic material used in the invention contains a spectral-sensitizing dye having the wavelength of maximum sensitivity of 600 nm or-more The wavelength of maximum sensitivity of 600 nm or more indicates that the maximum sensitivity is at a wavelength of 600 or more in the sensitivity distribution provided by a silver halide photothermographic material in which a sensitizing dye is incorporated and allowed to adsorb onto silver halide. The wavelength of maximum sensitivity is preferably 600 to 1100 nm, and more preferably 600 to 900 nm.

In the invention, a sensitizing dye exhibiting the maximum sensitivity at a wavelength of 600 nm or more and the heteroatom-containing macrocyclic compound described above are used in combination. Preferred sensitizing dyes exhibiting the maximum sensitivity at a wavelength of 600 nm or more include those represented by formulas (1), (2) and (3). Of the sensitizing dyes, those represented by formulas (2) and (3) are preferred, and those represented by formula (2) are more preferred, in which methylthio group (s) enhancing adsorption onto silver halide can be introduced.

In formula (1), $Z_1$ is an atomic group necessary to form a 5- or 6-membered nitrogen-containing heterocyclic ring; D and D' each represent an atomic group necessary to form a cyclic acidic nucleus; $R_1$ represents an alkyl group; $L_1$, $L_2$, $L_3$, $L_4$, $L_5$, $L_6$, $L_7$, $L_8$, $L_9$ and $L_{10}$ each represent a methine group, provided that each may form a ring together with the other L's (i.e., one of the other methine groups) or may form a ring with an auxochrome; n1, n2, n3, n4 and n5 are each 0 or 1; $M_1$ represents a counter ion necessary to neutralize charge; and m1 is the number of 0 or more, which is necessary to counterbalance intramolecular charge.

The compound represented by formula (1) will be detailed. $Z_1$ represents an atomic group necessary to form a 5- or 6-membered nitrogen-containing heterocyclic ring. Examples of a nucleus formed by $Z_1$ include a thiazole nucleus (e.g., thiazole, 4-methylthiazole, 4-phenylthiazole, , 4,5-dimethylthiazole, 4,5-diphenylthiazole), benzthiazole nucleus (e.g., benzthiazole, 4-chlorobenzthiazole, 5-chlorobenzthiazole, 6-chlorobenzthiazole, 5-nitrobenzthiazole, 4-methylbenzthiazole, 5-methylbenzthiazole, 6-methylbenzthiazole, 5-bromobenzothiazole, 6-bromobenzthiazole, 5-iodobenzthiazole, 5-phenylbenzthiazole, 5-methoxybenzthiazole, 6-methoxybenzthiazole, 5-ethoxybenzthiazole, 5-ethoxycarbonylbenzthiazole, 5-carboxybenzthiazole, 5-phenethylbenzthiazole, 5-fluorobenzthiazole, 5-chloro-6-methylbenzthiazole, 5,6-dimethylbenzthiazole, 5,6-dimethoxybenzthiazole, 5-hydroxy-6methylbenzthiazole, tetrahoydroxybenzthiazole, 5-phenylbenzthiazole), naththothiazole nucleus (e.g., naphtha[2,1-d]thiazole, naphtha[1,2-d]thiazole, naphtha[2,3-d]thiazole, 5-methoxynaphtho[1,2-d]thiazole, 7-ethoxynaphtho[2,1-d]thiazole, 8-methoxynaphtho[2,1-d]thiazole, 5-methoxynaphtho[2,3-d]thiazole), thiazoline nucleus (e.g., thiazoline, 4-methylthiazoline, 4-nitrothiazoline), oxazole nucleus (e.g., oxazole, 4-methyloxazole, 4-nitrooxazole, 5-methyloxazole, 4-phenyloxazole, 4,5-diphenyloxazole, 4-ethyloxazole), benzoxazole (benzoxazole, 5-phenylbenzoxazole, 5-methoxybenzoxazole, 5-bromobenzoxazole, 5-fluorobenzoxazole, 5-phenylbenzoxazole, 5-methoxybenzoxazole, 5-nitrobenzoxazole, 5-trifluoromethylbenzoxazole, 5-hydroxybenzoxazole, 5-carboxybenzoxazole, 6-methylbenzoxazole, 6-chlorobenzoxazole, 6-nitrobenzoxazole, 6-methoxybenzoxazole, 6-hydroxybenzoxazole, 5,6-dimethylbenzoxazole, 4,6-dimethylbenzoxazole, 5-ethoxybenzoxazole), naphthooxazole nucleus (e.g., naphtha[2,1-d]oxazole, naphtha[1,2-d]oxazole, naphtha[1,2-d]oxazole, naphtha[2,3-d]oxazole, 5-nitronaphtho[2,1-d]oxazole), oxazoline (e.g., 4,4-dimethyloxazoline), selenazole nucleus (e.g., 4-methlselenazole, 4-nitroselenazole, 4-phenylselenazole), benzselenazole nucleus (e.g., benzselenazole, 5-chlorobenzselenazole, 5-nitrobenzselenazole, 5-methoxybenzselenazole, 5-hydroxybenzselenazole, 6-nitrobenzselenazole, 5-chloro-6-nitrobenzselenazole, 5,6-dimnethylbenzselenazole), naphthoselenazole nucleus (e.g., naphtha[2,1-d]selenazole, naphtha[1,2-d]selenazole), selenazoline nucleus (e.g., selenazoline, 4-methylselenazoline), tellurazole nucleus (e.g., tellurazole, 4-methyltellurazole, 4-phenyltellurazole), benztellurazole nucleus (e.g., benztellurazole, 5-chlorobenztellurazole, 5-methylbenztellurazole, 5,6-dimethylbenztellurazole, 6-methoxybenztellurazole), naphthotellurazole nucleus (e.g., naphtha[2,1-d]tellurazole, naphtha[2,1-d]tellurazole), 3,3-dialkylindolenine (e.g., 3,3-dimethylindolenine, 3,3-diethylindolenine, 3,3-dimethyl-5-cyanoindolenine, 3,3-dimethyl-6-nitroindolenine, 3,3-dimethyl-5-methoxyindolenine, 3,3-dimethyl-5chloroindolenine), imidazole nucleus (e.g., 1-alkylimidazole, 1-alkyl-4-phenylimdazole, 1-alkyl-5,6-dichloroimidazole, 1-alkyl-5-methoxybenzimidazole, 1-alkyl-5-cyanobenzimidazole, 1-alkyl5-fluorobenzimidazole, 1-alkyl-5-trifluoromethylbenzimidazole, 1-alkyl-6-chlorocyanobenzimidazole, 1-alkyl-6-chloro5-trifluorobenzimidazole, 1-allyl-5,6-dichlorobenzimidazole, 1-allyl-5-chlorobenzimidazole, 1-aryl-benzimidazole, 1-aryl-5-chlorobenzimidazole, 1-aryl-5,6-dichlorobenzimidazole, 1-aryl-5-methoxybenzimidazole, 1-aryl-5-cyanobenzimidazole), naphthoimidazole nucleus (e.g., alkylnaphtho[1,2-d]imidazole, 1-arylnaphtho[1,2-d] imidazole), in which the alkyl group described above is preferably one having 1 to 8 carbon atoms such as methyl, ethyl, propyl, isopropyl, butyl or hydroxyalkyl group such as 2-hydroxyethyl 3-hydroxypropyl; the aryl group described above is preferably phenyl, a halogen-substituted (e,g., chloro-substituted) phenyl, alkyl-substituted (e.g., methyl-substituted) phenyl and alkoxy-substituted (e.g., methoxy-substituted) phenyl; pyridine nucleus (e.g., 2-pyridine, 4-pyridine, 5-methyl-2-pyridine, 3-methyl-4-pyridine), a quinoline nucleus (e.g., 2-quinoline, 3-methyl-2-quinoline, 5-ethyl-2-quinoline, 6-methyl-2-quinoline, 6-nitro-2-quinoline, 8-fluoro-2-quinoline, 6-methoxy-2-quinoline, 6-hydroxy-2-quinoline, 8-chloro-2-quinoline, 4-quinoline, 6-ethoxy-4-quinoline, 6-phenyl-4-quinoline, 8-chloro4-quinoline, 8-fluoro-4-quinoline, 8-methyl-4-quinoline, 8-methoxy-4-quinoline, 6-methyl-4-quinoline, 6-methoxy-4-quinoline, 6-chloro4-quinoline), an isoguinoline nucleus (e.g., 6-nitro-1-isoquinoline, 3,4-dihydro-1-isoquinoline, 6-nitro-3-isoquinoline), an imidazo[4,5-b]quinoxaline nucleus (e.g., 1,3-diethylimidazo[4,5-b]quinoxaline, 6-chloro-1,3-diallylimidazo[4,5-b]quinoxaline), an oxadiazole nucleus, a thiadiazole nucleus, a tetrazole nucleus and a pyrimidine nucleus. Of these are preferred a benzoxazole nucleus, naphthothiazole nucleus, benzoxazole nucleus, naphthoxazole nucleus, benzimidazole nucleus, 2-guinoline nucleus and 4-guinoline nucleus.

D and D' each represent an atomic group necessary to form a cyclic, acidic nucleus, including any form of an acidic nucleus of commonly known merocyanine dyes. In a preferred form, D is a thicarbonyl group or carbonyl group, and D' is a group of residual atom(s) necessary to form an acidic nucleus. Herein, the acidic nucleus is referred to as an acidic (or electron donating) heterocyclic nucleus, as is commonly known in the art [e.g., T. H. James, The Theory of the Photographic Process, 4th ed. (Macmillan, 1977) page 198]

Thus, D and D' can combine together with each other to form a 5- or 6-membered heterocyclic ring comprising a carbon atom, a nitrogen atom and a chalcogen atom (such as oxygen, sulfur, selenium, or tellurium). Preferred nuclei include 2-pyrazoline-5-one, pyrazolidine-3,5-dione, imidazolidine-5-one, hydantoin, 2- or 4-thiohydantoin, 2-iminooxazolidine-4-one, 2-oxazoline-5-one, 2-thiooxazolidine-2,4-dione, isooxazoline-5-one, 2-thiazoline-4-one, thiazoline-4-one, thiazoline-2,4-dione, rhodanine, thiazolidine2,4-dithione, isorhodanine, indane-1, 3-dione, thiophene-3-one, thiophene-3-one-1,1-dioxide, indoline-2-one, indoline-3-one, indazoline-3-one, 2-oxoindazolinium, 3-oxoindazolinium, 5,7-dioxo-6,7-dihydothiazolo[3,2-a]pyrimidine, cyclohexane-1,3-dione, 3,4-dihydroisoquinoline-4one, 1,3-dioxane-4,6-dione, barbituric acid, 2-thiobarbituric acid, chromane-2,4-dione, indazoline- 2-one, and pyrido[1,2-a]pyrimidine-1,3-dione nuclei; and a nucleus having an exomethylene structure, in which a carbonyl group or thiocarbonyl group is substituted by an active methylene compound having a ketomethylene of cyanomethylene structure at the active methylene-position. Of these are more preferred 3-alkylrhodanine, 3-alkyl-2-thiooxazoline-2,4-dione and 3-alkyl-2-thiohydantoin, and is still more preferred a nucleus containing a carboxy group in its molecule.

A group attached to the nitrogen atom contained in the nucleus is preferably a hydrogen atom, an alkyl group preferably having 1 to 18 carbon atoms, more preferably 1 to 7 carbon atoms and still more preferably 1 to 4 carbon atoms (e.g., methyl ethyl propyl, isopropyl, butyl, isobutyl, hexyl octyl, dodecyl octadecyl); substituted alkyl group such as aralkyl (e.g., benzyl, 2-phenylethyl), hydroxyalkyl (e.g., 2-hyroxyethyl, 3-hydroxypropyl),a mercaptoalkyl (e.g., 2-mercaptoethyl), carboxyalkyl (e.g., 2-carboxyethyl, 3-carboxypropyl, 4-carboxybutyl, carboxymethyl), alkoxyalkyl (e.g., 2-methoxyethyl, 2-(2-hydroxyethoxy)ethyl, 2-(2-methoxyethoxy)ethyl), aryloxyalkyl (e.g., 1-naphthyloxy), sulfoalkyl (e.g., 2-sulfoethyl, 3-sulfopropyl, 3-sulfobutyl, 4-sulfobutyl, 2-(3-sulfopropoxy) ethyl, 2-hydroxy-3-sulfopropyl, 3-sulfopropoxyethoxyethyl), arylthioalkyl (e.g., phenylthioethyl), heterocyclic ring-substituted alkyl (e.g., 2-g(pyrrolidine-2-one-1-yl)ethyl, tetrahydrofurfuryl, 2-morpholinoethyl), 2-acetoxyethyl, carbomethoxygethyl, 2-methanesulfonylaminoethyl); an aryl group such as aryl (e.g., phenyl, 2-naphthyl) and substituted aryl (4-carboxyphenyl, 4-sulfophenyl, 3-chlorophenyl3-methylphenyl); and a heterocycric group (e.g., 2-pyridyl, 2-thiazolyl, 5-pyrazolyl, 3-methyl-5-pyrazolyl). Of these are more preferred an unsubstituted alkyl group (e.g., methyl, ethyl, n-propyl, n-butyl, n-pentyl, n-hexyl), a carboxyalkyl group (e.g., carboxymethyl, 2-carboxyethyl) and a sulfoalkyl group (2-sulfoethyl).

Substitution at the carbon atom contained in the nucleus is feasible with substituent groups which are defined as a substituent for polycyclic nuclei of $Z_1$.

$L_1$, $L_2$, $L_3$, $L_4$, $L_5$, $L_6$, $L_7$, $L_8$, $L_9$ and $L_{10}$ each represent a methine group or a substituted methine group substituted by a substituted or unsubstituted alkyl group (e.g., methyl ethyl, caboxyethyl), a substituted or unsubstituted aryl group (e.g., phenyl, o-carboxyphenyl), a heterocyclic group (e.g., thienyl, barbituric acid), a halogen atom (e.g., chlorine atom, bromine atom), an alkoxy group (e.g., methoxy, ethoxy), amino group (N,N-dipenylamino, N-methyl-N-phenylamino, N-methylpiperadino) and an alkylthio group (e.g., methylthio, ethylthio), provided that each may form a ring together with one of the other L's or one of the other methine groups, or form a ring with an auxochrome. Herein, the auxochrome, as is commonly known in the art, refers to a functional group of atoms (or a substituent group) which, by affecting the spectral regions of strong absorption in a chromophore, enhance the ability of the chromogen to act as a dye. Examples thereof include groups containing a lone pair such as —OH, —OR, —SH, —NH2, —NHR, NR2, halogen, in which R is a hydrocarbon group; electron-donating groups such as an alkyl group; and electron-withdrawing groups such as a carboxy group and sulfonic acid group.

Further, either $L_2$ and $L_4$, or $L_3$ and $L_5$ preferably form a ring. Specifically preferred examples of the ring formed by L2 and $L_4$ include:

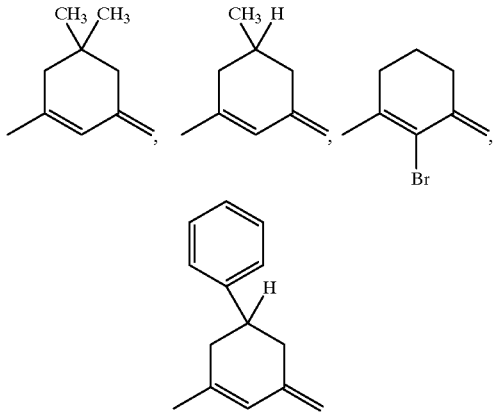

Preferred examples of the ring formed by $L_3$ and $L_5$ include:

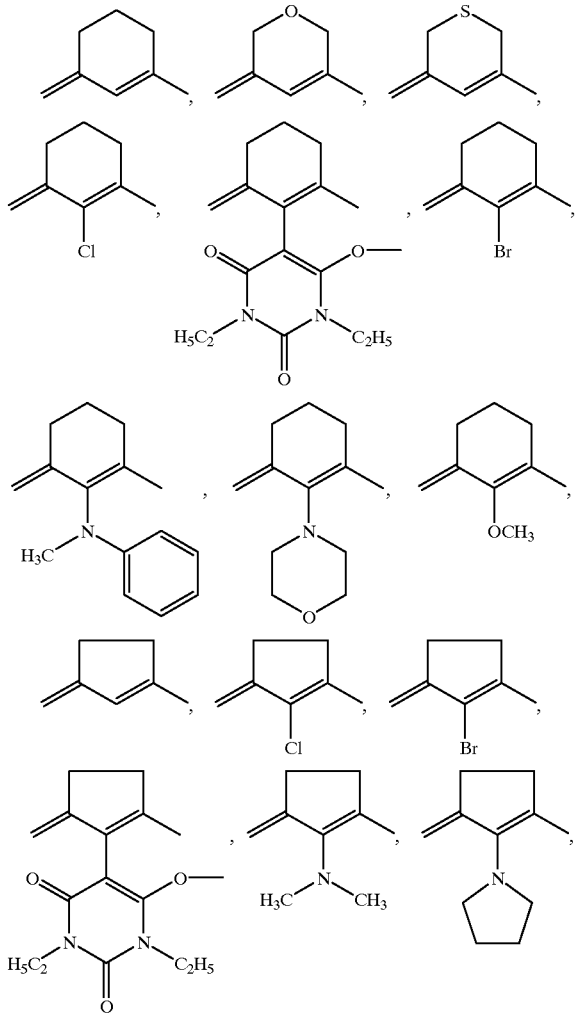

$L_4$ is preferably an unsubstituted methine group, a methine group substituted with an unsubstituted alkyl group (e.g., methyl), an alkoxy group (e.g., methoxy), an amino group (e.g., N,N-diphenylamino), a halogen atom (e.g., chlorine) or an acidic nucleus represented by D and D'.

Other Ls each are preferably an unsubstituted methine group.

Each of $n_1$, $n_2$, $n_3$, $n_4$ and $n_5$ is 0 or 1.

R1 is an alkyl group. Preferred examples of the alkyl group are an unsubstituted alkyl group having 1 to 18 carbon atoms (e.g., methyl, ethyl, propyl, pentyl, octyl, decyl, dodecyl, octadecyl) and a substituted alkyl group having not more than 18 carbon atoms. The substituent includes carboxy group, sulfo group, cyano, a halogen atom (e.g., fluorine, chlorine, bromine), hydroxy, alkoxycarbonyl group having 8 or less carbon atoms, which may be substituted (e.g., methoxycarbonyl, ethoxycarbonyl, phenoxycarbonyl, benzyloxycarbonyl), alkoxy group having 8 or less carbon atoms, which may be substituted (methoxy, ethoxy, benzyloxy, phenetyloxy), aryloxy group having 20 or less carbon atoms (e.g., phenoxy, p-tolyloxy, 1-naphthyloxy, 2-naphthyloxy, 6-methoxy-1-naphthyloxy), acyloxy group having 3 or less carbon atoms, which may be substituted (e.g., acetyloxy, propionyloxy), acyl group having 8 or less carbon atoms (e.g., acetyl, propionyl, benzoyl, mesyl), acylamino group having 10 or less carbon atoms, which may be substituted (e.g., acetylamino, 2-mercapto-6-benzimidazolylcarbonylamino), carbamoyl group having 8 or less carbon atoms, which may be substituted (e.g., carbamoyl, N,N-dimethylcarbamoyl, morpholinocarbonyl, piperidinocarbonyl), sulfamoyl group having 8 or less carbon atoms (e.g., sulfamoyl, N,N-dimethylsulfamoyl, morpholinosulfonyl, piperidinosulfonyl), and aryl group having 10 or less carbon atoms, which may be substituted (e.g., phenyl, 4-chlorophenyl, 4-methylphenyl, α-naphthyl). Of these are more preferred an unsubstituted alkyl group having 1 to 18 carbon atoms (e.g., methyl, ethyl, n-propyl, n-butyl, n-pentyl, n-hexyl), a carboxyalkyl group (e.g., 2-carboxyethyl, carboxymethyl), and a sulfoalkyl group (e.g., 2-sulfoethyl, 3-sulfopropyl, 4-sulfobutyl, 3-sulfobutyl).

$M_1$ is a counter ion to neutralize charge and m1 is a Alnumber of 0 or more, which is necessary to-neutralize an intramolecular charge. (M1)m1 is included in the formula to indicate the presence or absence of a cation or an anion, when it is needed to neutralize ionic charge of a dye. Whether a dye is a cation or anion, or whether the dye has a net ionic charge depends of an auxochrome or a substituent.

Representative cations are a inorganic or organic ammonium ion and an alkali metal ion. Anions may be inorganic or organic anions, including a halide anion (e.g., fluoride ion, chloride ion, bromide ion, iodide ion), a substituted arylsulfonate ion (e.g., p-toluenesulfonate ion, p-chlorobenzenesulfonate ion), an aryldisulfonate ion (e.g., 3-naphthalendisulfonate ion), an alkyl sulfate ion (e.g., methylsulfate ion), sulfate ion, thicyanate ion, perchlorate ion, tetrafluorobarate ion, picrate ion, acetate ion, and trifluoromethansulfonate ion. Of theses are preferred ammonium ion, iodide ion and p-toluenesulfonate ion.

Exemplary examples of sensitizing dyes represented by formula (1) are shown below, but are not limited to these examples.

D-1
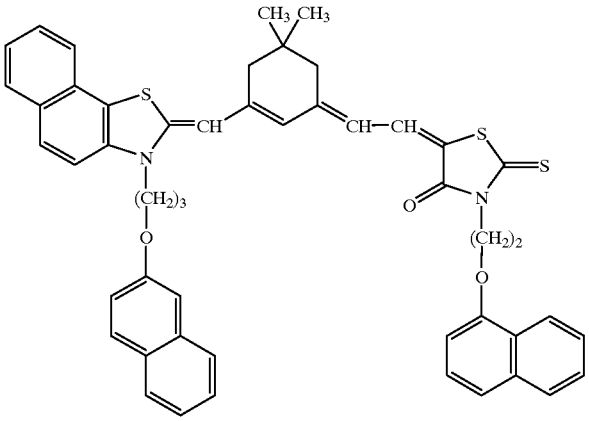
D-2
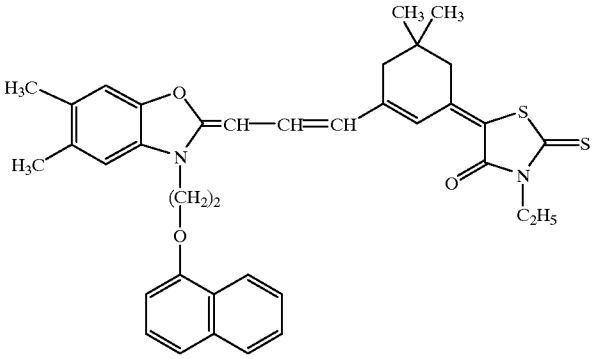
D-3
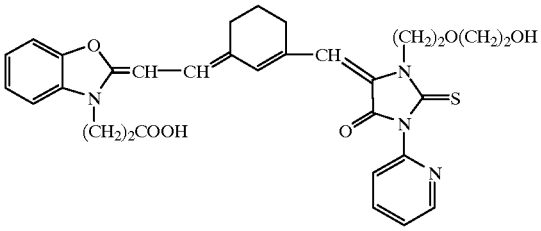
D-4
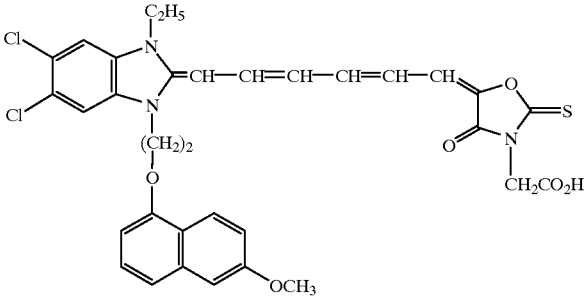
D-5
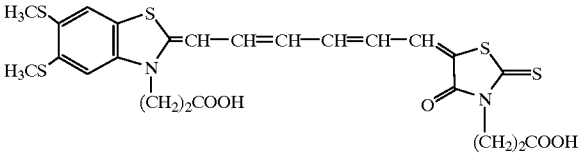
D-6
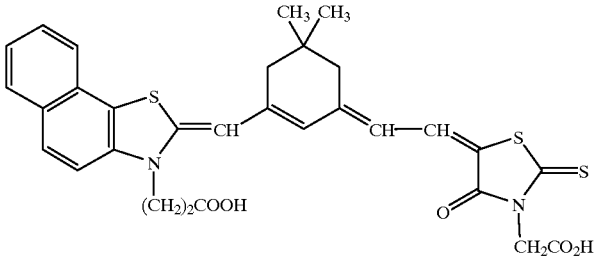
D-7
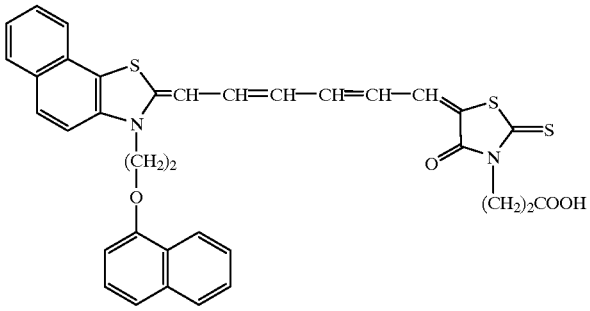
D-8
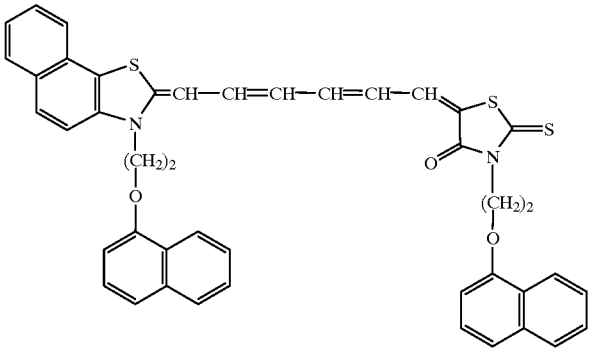

-continued
D-9
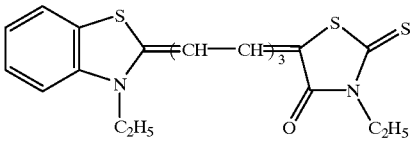
D-10
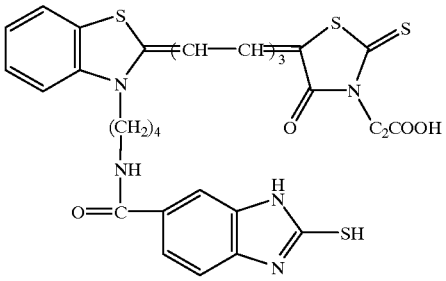
D-11
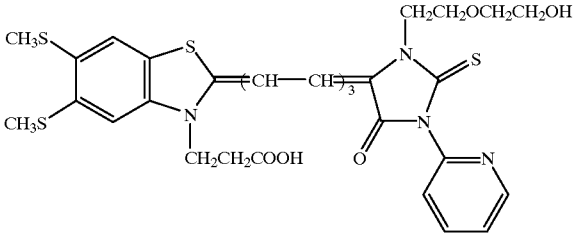
D-12
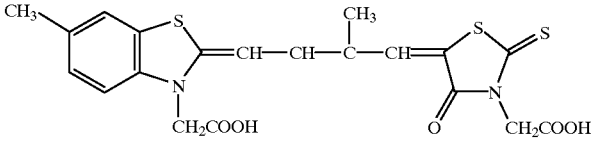
D-13
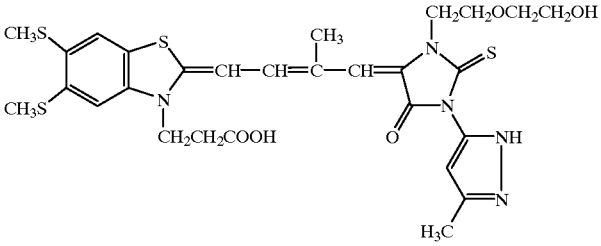
D-14
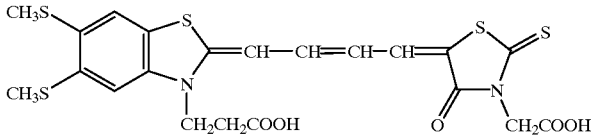
D-15
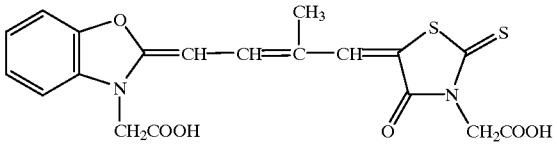
D-16
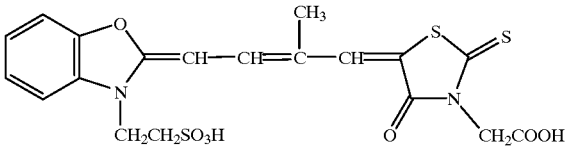
D-17
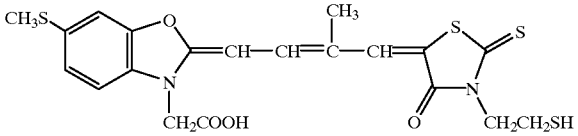
D-18
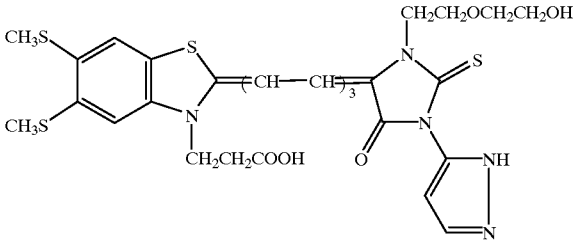
D-19
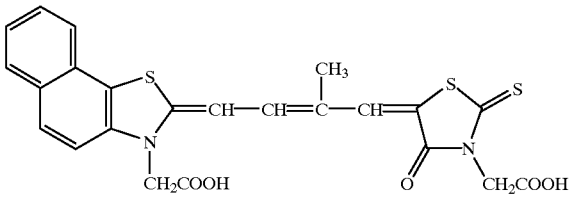
D-20
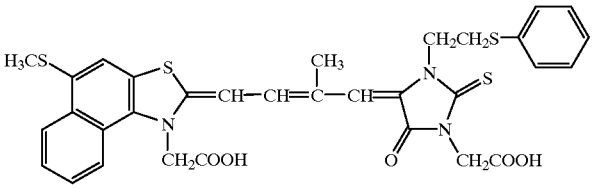

-continued

D-21

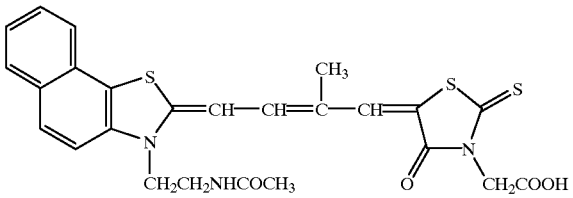

D-22

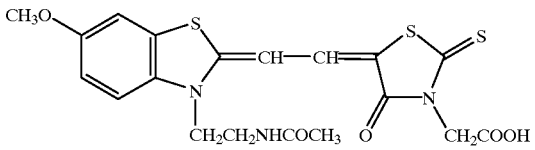

D-23

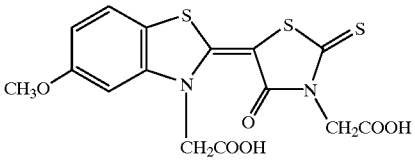

D-24

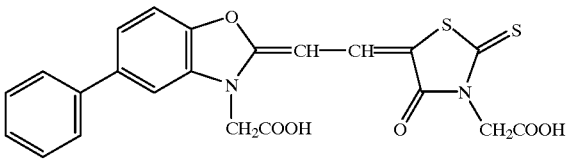

D-25

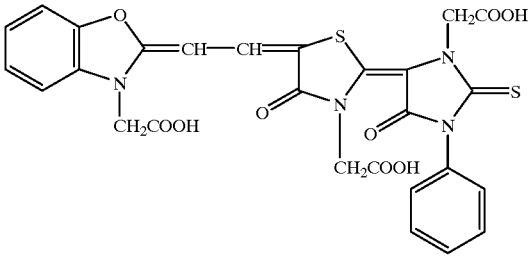

D-26

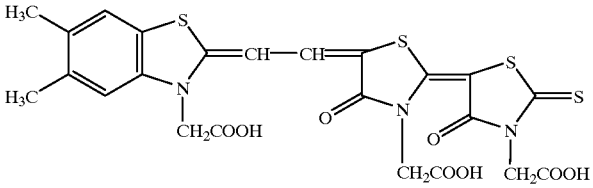

D-27

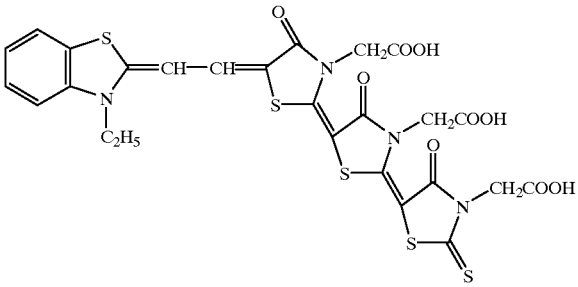

D-28

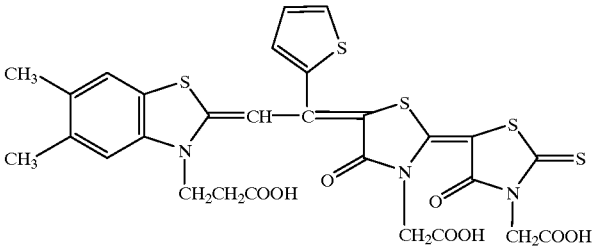

The sensitizing dyes represented by formula (1), i.e., merocyanine dyes can be synthesized in accordance with methods described in the following literatures; (a) F. M. Hamer, "Cyanine Dyes and Related Compounds" in The Chemistry of Heterocyclic Compounds Vol. 18 (Interscience, New York, 1964), (b) D. M. Sturmer, "Heterocyclic Compounds, Special Topic in The Chemistry of Heterocyclic Compounds" Chapter 8, Sect. 4 pages 482–515 (John Wirey & Sons, New York, 1977) (c) Zh. Org. Khim. Vol.17 (1) page 167–169 (1981), ibid Vol. 15 (2) page 400–407 (1979), ibid Vol. 14 (10) page 2214–2221 (1978), ibid Vol. 13 (11) page 2440–2443 (1977),ibid Vol. 19 (10) page 2134–2142 (1982); Ukr. Khim. Zh. Vol. 40 (6) page 625–629 (1974); Khim. Geterotsiki. Soedin. Vol. 2 page 175–178 (1976); Russian Patent Nos. 420643 and 341823; JP-A 59-217761; U.S. Pat. Nos. 4,334,000, 3,671,648, 3,623,881, and 3,573,921; European Patent 288261A1, 102781A2, 730008A2; JP-A 49-46930 and 3-243944.

Spectral-sensitizing dyes represented by formulas (2) and (3) will now be described. Of sensitizing dyes represented by formula (2) is more preferred a methine dye represented by formula (4) described above.

In formulas (2), (3) and (4), 5- or 6-membered nitrogen-containing heterocyclic rings represented by $Z_1$, $Z_3$, $Z_4$ and $Z_7$ include a thiazole nucleus, thiazole nucleus, benzothiazole nucleus, oxazoline nucleus, oxazole nucleus, benzoxazole nucleus, selenazoline nucleus, selenazole nucleus, benzoselenazole nucleus, 3,3-dialkylindolenine nucleus (e.g., 3,3-dimethylindolenine), imidazoline nucleus, imidazole nucleus, benzimidazole nucleus, 2-pyridine nucleus, 4-pyridine nucleus, 2-quinoline nucleus, 1-isoquinoline nucleus, 3-isoquinoline v, imidazo[4,5-b]quinoxaline nucleus, oxadiazole nucleus, thiadiazole nucleus, tetrazole v and pyrimidine nucleus. Of these, a benzoxazole nucleus, thiazole nucleus, benzothiazole nucleus, benzoselenazole nucleus and benzoimidazole nucleus are preferred, benzooxazole nucleus, thiazole nucleus and benzothiazole nucleus are more preferred, and benzothiazole nucleus specifically preferred. Of nuclei described above, a pyridine and quinoline nuclei are preferred as a heterocyclic group substituted by a thioether group.

When a substituent onto $Z_1$, $Z_3$, $Z_4$ or $Z_7$ is denoted as "V", examples of the substituent, V include a halogen atom (e.g., fluorine, chlorine, bromine, iodine); mercapto group; a carboxy group; a phosphoric acid group; a sulfo group; hydroxy group; a carbamoyl group (hereinafter "carbamoyl group" means a carbamoyl group, which may be substituted, e.g., a carbamoyl group preferably having 1 to 10 carbon atoms, more preferably 2 to 8 carbon atoms, and still more preferably 2 to 5 carbon atoms, such as methylcarbamoyl, ethylcarbamoyl, and morpholinocarbamoyl); a sulfamoyl group (which may be substituted), e.g., preferably having 10 or less carbon atoms, more preferably 2 to 8 carbon atoms, and still more preferably 2 to 5 carbon atoms, such as methylsulfamoyl, ethylsulfamoyl and piperidinosulfamoyl; nitro group; an alkoxy group (which may be substituted) e.g., preferably having 1 to 20 carbon atoms, more preferably 1 to 10 carbon atom, and still more preferably 1 to 8 carbon atoms (e.g., methoxy, ethoxy, 2-methoxethoxy, 2-phenylethoxy); an aryloxy group (which may be substituted), e.g., preferably having 6 to 20 carbon atoms, more preferably 6 to 12 carbon atom, and still more preferably 6 to 10 carbon atoms (e.g.,phenoxy, p-methylphenoxy, p-chlorophenoxy, naphthoxy); an acyl group (which may be substituted), e.g., preferably having 1 to 20 carbon atoms, more preferably 2 to 12 carbon atom, and still more preferably 2 to 8 carbon atoms (e.g., acetylamino); a sulfonyl group (which may be substituted), e.g., preferably having 1 to 20 carbon atoms, more preferably 1 to 10 carbon atom, and still more preferably 1 to 8 carbon atoms (e.g., methanesulfonyl, ethanesulfonyl, benzenesulfonyl); a sulfinyl group (which may be substituted, e.g., preferably having 1 to 20 carbon atoms, more preferably 1 to 10 carbon atom, and still more preferably 1 to 8 carbon atoms (e.g., methanesulfinyl, bebzenesulfinyl); a sulfonylamino group (which may be substituted), e.g., preferably having 1 to 20 carbon atoms, more preferably 1 to 10 carbon atom, and still more preferably 1 to 8 carbon atoms (e.g., methanesulfonylamino, ethanesulfonylamino, benzenesulfonylamino); amino and a substituted amino group (which may be substituted), e.g., preferably having 1 to 20 carbon atoms, more preferably 1 to 10 carbon atom, and still more preferably 1 to 8 carbon atoms (e.g., methylamino, dimethylamino, benzylamino, anilino, diphenylamino); an ammonium group (which may be substituted), preferably having 20 or less carbon atoms, more preferably 3 to 10 carbon atom, and still more preferably 3 to 6 carbon atoms (e.g., trimethylammonium, triethylammonium); a hydrazine group (e/g., trimethylhydrazino); a ureido group (which may be substituted), e.g., preferably having 1 to 15 carbon atoms, more preferably 1 to 10 carbon atom, and still more preferably 1 to 6 carbon atoms (e.g., ureido, N,N-dimethylureido); an imino group (which may be substituted), e.g., preferably having 1 to 15 carbon atoms, more preferably 1 to 10 carbon atom, and still more preferably 1 to 6 carbon atoms (e.g., succinimido); alkyl- or aryl-thio group (which may be substituted), e.g., preferably having 1 to 20, carbon atoms, more preferably 1 to 12 carbon atom, and still more preferably 1 to 8 carbon atoms; an alkoxycarbonyl group (which may be substituted), e.g., preferably having 2 to 20 carbon atoms, more preferably 2 to 12 carbon atom, and still more preferably 2 to 6 carbon atoms (e.g., methoxycarbonyl, ethoxycarbonyl, benzylcarbonyl); an aryloxycarbonyl group (which may be substituted), e.g., preferably having 6 to 20 carbon atoms, more preferably 6 to 12 carbon atom, and still more preferably 6 to 8 carbon atoms (e.g., phenoxycarbonyl); an alkyl group, e.g., preferably having 1 to 18 carbon atoms, more preferably 1 to 10 carbon atom, and still more preferably 1 to 5 carbon atoms (e.g., methyl, ethyl, propyl, butyl); a substituted alkyl preferably having 1 to 18 carbon atoms, more preferably 1 to 10 carbon atom, and still more preferably 1 to 5 carbon atoms (e.g., hydroxymethyl, trifluoromethyl, benzyl, carboxymethyl, ethoxycarbonylmethyl, acetylaminomethyl); unsaturated hydrocarbon group preferably having 2 to 18 carbon atoms, more preferably 3 to 10 carbon atom, and still more preferably 3 to 5 carbon atoms (e.g., vinyl, ethynyl, 1-cyclohexenyl); an aryl group (which may be substituted), e.g., substituted or unsubstituted aryl group preferably having 6 to 20 carbon atoms, more preferably 6 to 15 carbon atom, and still more preferably 6 to 10 carbon atoms (e.g., phenyl, naphthyl, p-carboxyphenyl, p-nitrophenyl, 3,5-dichlorophenyl, p-cyanophenyl, m-fluorophenyl, p-tolyl); and a heterocyclic group (which may be substituted), e.g., preferably having 1 to 20 carbon atoms, more preferably 2 to 10 carbon atom, and still more preferably 4 to 6 carbon atoms (e.g., pyridyl, 5-methylpyridyl, thienyl, furyl, morpholino, tetrahydrofurfuryl), which may be condensed with a benzene ring, naphthalene ring, or antrecene ring. These substituents may be further substituted with substituent V. Of these are preferred an alkyl group, aryl group, alkoxy group, alkylthio group, halogen atom, acyl group, cyano group, sulfonyl group and benzene ring-condensed group; and an alkyl group, aryl group, alkylthio group, halogen atom, acyl group, sulfonyl group and benzene ring-condensed group are more preferred. Specifically, methyl, phenyl, methoxy, methylthio, chlorine atom, bromine atom, iodine atom and benzene ring-condensed group are still more preferred, and phenyl, methylthio, chlorine atom, bromine atom, iodine atom and benzene ring-condensed group are optimum.

The methine groups represented by $L_1$, $L_2$, $L_8$, $L_9$, $L_{10}$, $L_{11}$, $L_{16}$ and $L_{17}$ each may be substituted, and examples of substituents include those as defined in V described above. An unsubstituted methine group is preferred.

p1, p2, p3 and p4 are each 0 or 1, and preferably 0.

$Z_9$ is an oxygen atom, a sulfur atom and a selenium atom, preferably an oxygen atom or sulfur atom, and more preferably a sulfur atom.

$Z_6$ represents an atomic group necessary to form an acidic nucleus and may take any form of acidic nuclei of commonly known merocyanine dyes. Herein, the acidic nucleus (or acidic heterocycles) is defined in T. H. James, The Theory of the Photographic Process, 4th ed. (Macmillan, 1977) page 198 and exemplarily detailed in U.S. Pat. Nos. 3,567,719, 3,575,869, 3,804,634, 3,837,862, 4,002,480 and 4,925,777; and JP-A 3-167546. The acidic nucleus is preferably a 5- or 6-membered nitrogen-containing heterocyclic ring comprised of a carbon atom, nitrogen atom and chalcogen atom (exemplarily, oxygen, sulfur, selenium and tellurium), including the following nuclei:

2-pyrazoline-5-one, pyrazolidine-3,5-dione, imidazoline-5-one, hydantoin, 2- or 4-thiohydantoin, 2-iminooxazolidine, 2-oxazoline-5-one, 2-thiooxazoline-2,4-dione, isorhodanine, indane-1,3-dione, thiophene3-one, thiophene-3-one-1,1-dioxide, indoline-2-one, indoline-3-one, 2-oxoindazolinium, 3-oxoindazolinium, 5,7-dioxo-6,7-dihydrothiazolo[3,2-a]pyrimidine, cyclohexane-1,3-dione, 3,4-dihydroisoquinoline-4-one, 1,3-dioxane-4,6-dione, barbituric acid, 2-thiobarbituric acid, chromene2,4-dione, indazoline-2-one, pyrido[1,2-a]pyrimidine-1,3-dione, pyrazolo[1,5-b]quinazolone, pyrazolo[1,5-a]benzimidazole, pyrazolopyridone1,2,3,4-tetrahydroguinoline-2,4-dione, 3-oxo-2,3-dihydrobenzo[d]thiophene-1,1-dioxide, 3-dicyanomethine-2,3-dihydrobenzo[d]thiophene-1,1-dioxide, 3-dicyanomethine-2,3-dihydrobenzo[d]thiophene-1,1-dioxide. Of these nuclei, $Z_6$ is preferably hydantoin, 2- or 4-thiohydantoin, 2-oxazoline-5-one, 2-thiooxazoline-2,4-dione, thiazolidine-2,4-dione, rhodanine, thiazolidine-2,4-dithione, barbituric acid and 2-thiobarbituric acid; more preferably hydantoin, 2- or 4-thiohydantoin, 2-oxazoline-5-one, rhodanine, barbituric acid and 2-thiobarbituric acid; and still more preferably 2- or 4-thiohydantoin, 2-oxazoline-5-one and rhodanine.

5- or 6-membered nitrogen-containing heterocyclic rings represented by $Z_2$, $Z_5$, and $Z_8$ are those in which an oxo or thioxo group is excluded from the heterocycle represented by $Z_6$. Thus, these heterocyclic rings are preferably those in which an oxo or thioxo group is excluded from hydantoin, 2-or 4-thiohydantoin, 2-oxazoline-5-one, 2-thiooxazoline-2, 4-dione, thiazolidine-2,4-dione, rhodanine, thiazolidine-2,4-dithione, barbituric acid and 2-thiobarbituric acid; more preferably those in which an oxo or thioxo group is excluded from hydantoin, 2- or 4-thiohydantoin, 2-oxazoline-5-one, rhodanine, barbituric acid and 2-thiobarbituric acid, and still more preferably those in which an oxo or thioxo group is excluded from 2- or 4-thiohydantoin, 2-oxazoline-5-one and rhodanine.

R1, R3, R4, R7 and R9 each are an alkyl group, including an unsubstituted alkyl group preferably having 1 to 18 carbon atoms, more preferably 1 to 7, and still more preferably 1 to 4 carbon atoms (e.g., methyl, ethyl, propyl, isopropyl, butyl, isobutyl, hexyl, octyl, dodecyl, octadecyl); and a substituted alkyl group preferably having 1 to 18 carbon atoms, more preferably 1 to 7, and still more preferably 1 to 4 carbon atoms, in which substituents include those as defined in V described above. Preferred examples of the substituted alkyl group include an aralkyl group (e.g., benzyl, 2-phenylethyl), unsaturated hydrocarbon group (e.g., allyl), hydroxyalkyl group (e.g., 2-hydroxyethyl, 3-hydroxypropyl), carboxyalkyl group (e.g., 2-carboxyethyl, 3-carboxypropyl, 4-carboxybutyl, carboxymethyl), alkoxyalkyl group (e.g., 2-methoxyethyl, 2-(2-methoxyethoxy)ethyl), aryloxyalkyl group (e.g., 2-phenoxyethyl, 2-(1-naphthoxy)ethyl), alkylthioalkyl group (e.g., 2-methylthioethyl, 2-(2-methylthioethylthio) ethyl), arylthioalkyl group (e.g., 2-phenylthioethyl, 2-(1-naphthyl)ethyl), heterocyclylthioalkyl group (e.g., 2-pyridylthioethyl, 2-thienylthioethyl), alkoxycarbonylalkyl group (e.g., ethoxycarbonylmethyl, 2-benzyloxycarbonylethyl), aryloxycarbonylalkyl group (e.g., 3-phenoxycarbonylpropyl), acyloxyalkyl group (e.g., 2-acetyloxyethyl), acylalkyl group (e.g., 2-acetylethyl), carbamoylalkyl group (e.g., 2-morpholinocarbonylethyl), sulfamoylalkyl group (e.g., 2-sulfoethyl, 3-sulfopropyl, 3-sulfobutyl, 4-sulfobutyl, 2-(3-sulfopropoxy)ethyl, 2-hydroxy-3-sulfopropyl, 3-sulfopropoxyethoxyethyl), sulfoalkenyl group (e.g., sulfopropenyl), sulfatoalkyl group (e.g., 2-sulfatoethyl, 3-sulfatopropyl, 4-sulfatobutyl), heterocycle-substituted alkyl group (e.g., 2-pyrolidine-2-one-1-yl)ethyl, tetrahydrofurfuryl), and alkylsulfonylcarbamoylmethyl group (e.g., methanesulfonylcarbamoylmethyl). Of these, carboxyalkyl group, sulfoalkyl group, sulfoalkenyl group, unsubstituted alkyl group, alkylthioalkyl group, arylthioalkyl group and heterocyclylthioalkyl group are preferred.

The alkyl group represented by $R_2$, $R_5$, $R_6$ and $R_8$ include unsubstituted alkyl group and substituted alkyl groups as defined in $R_1$ described above. The aryl group include an unsubstituted aryl group preferably having 6 to 20 carbon atoms, more preferably 6 to 10 and still more preferably 6 to 8 carbon atoms (e.g., phenyl, 1-naphthyl) and substituted aryl group preferably having 6 to 20 carbon atoms, more preferably 6 to 10, and still more preferably 6 to 8 carbon atoms (e.g., aryl groups substituted by V as defined as a substituent in $Z_1$, such as p-methoxyphenyl, p-methylphenyl, or p-chlorophenyl). The heterocyclic group include an unsubstituted heterocyclic group having preferably 1 to 20 carbon atoms, more preferably 3 to 10 carbon atoms, and still more preferably 4 to 8 carbon atoms (e.g., 2-furyl, 2-thienyl, 2-pyridyl, 3-pyrazolyl, 3-isooxazolyl, 3-isothiazolyl, 2-imidazolyl, 2-oxazolyl, 2-thiazolyl, 2-pyridadyl,2-pyrimidyl, 3-pyrazyl, 2-(1,3,5-triazolyl), 3-(1, 2,4-triazolyl), 5-tetrazolyl) and substituted heterocyclic groups having preferably 1 to 20 carbon atoms, more preferably 3 to 10 carbon atoms, and still more preferably 4 to 8 carbon atoms (e.g., heterocyclic groups substituted by V as defined as a substituent in $Z_1$, such as 5-methyl-2-thienyl, 4-methoxy-2-pyridyl). Of these, $R_2$, $R_5$, $R_6$ and $R_8$ are preferably methyl, ethyl, 2-sulfoethyl, 3-sulfopropyl, 3-sulfobutyl, 4-sulfobutyl, carboxymethyl, 2-methylthioethyl, 2-phenylthioethyl, phenyl, 2-pyridyl and 2-thiazolyl.

$L_3$, $L_4$, $L_5$, $L_6$, $L_7$, $L_{12}$, $L_{13}$, $L_{14}$, $L_{15}$, $L_{18}$, $L_{19}$, $L_{20}$, $L_{21}$ and $L_{22}$ are each a methine group, which may be substituted. Examples of substituents include an unsubstituted or substituted alkyl group having preferably 1 to 15 carbon atoms, more preferably 1 to 10 carbon atoms, and still more preferably 1 to 5 carbon atoms; an unsubstituted or substituted aryl group having preferably 6 to 20 carbon atoms, more preferably 6 to 15 carbon atoms, and still more preferably 6 to 10 carbon atoms (e.g., phenyl, o-carboxyphenyl); an unsubstituted or substituted heterocyclic group having preferably 3 to 20 carbon atoms, more preferably 4 to 15 carbon atoms, and still more preferably 6 to 10 carbon atoms (e.g., N,N-diethylbarbituric acid); a halogen atom (fluorine, chlorine, bromine, iodine); an alkoxy group having preferably 1 to 15 carbon atoms, more preferably 1 to 10 carbon atoms, and still more preferably 1 to 5 carbon atoms (e.g., methoxy, ethoxy);an alkylthio group having preferably 1 to 15 carbon atoms, 1 to 10 carbon atoms and still more preferably 1 to 5 carbon atoms (e.g., methylthio, ethylthio); an arylthio group having 6 to 20 carbon atoms, more preferably 6 to 15 carbon atoms, and still more preferably 6 to 10 carbon atoms (e.g., phenylthio); and an amino group having preferably 0 to 15 carbon atoms, more preferably 2 to 10 carbon atoms, and still more preferably 4 to 10 carbon atoms (e.g., N,N-diphenylamino, N-methyl-N-phenylamino, N-methylpiperadino). The methine group defined above may form a ring together with other methine group or may form a ring together with $Z_1$, $Z_3$, $Z_4$, $Z_7$, $R_1$, $R_3$, $R_4$, $R_7$, or $R_9$.

n1, n2, n3, n4, n5 and n6 are each 0, 1, 2, 3 or 4; n1, n3 and n5 are preferably 0, 1, 2 or 3, more preferably 0 or 1, and still more preferably 1; n2, n4 and n6 are preferably 0,1, 2 or 3, preferably 0 or 1, and still more preferably 0. When n1, n2, n3, n4, n5 and n6 are 2 or more, a methine group is repeated but is not necessarily the same.

M1, M2 and M3, which is to be necessary to counterbalance a charge of a dye, is contained in the formula to indicate the presence of a cation or anion. Exemplary examples of cations include a hydrogen ion (H+), inorganic cations such as an alkali metal ion (e.g., sodium ion, potassium ion, lithium ion) and alkali earth metal ion (e.g., calcium ion), and organic ions such as ammonium ion (e.g., ammonium ion, tetraalkylammonium ion, pyridinium ion and ethylpyridinium ion). Anions include inorganic anions and organic anions, such as halogen anions (e.g., fluoride ion, chloride ion, iodide ion), substituted arylsulfonate ions (p-toluenesulfonate ion, p-chlorobenzenesulfonate ion), aryldisulfonate ions (e.g., 1,3-benzenedisulfonate ion, 1,5-naphthalenedisulfonate ion, 2,6-naphthalenedisulfonate ion) alkylsulfate ions (e.g., methylsulfate ion), sulfate ion, thi6cyanate ion, perchlorate ion, tetrafluoroborate ion, picrinate ion, acetate ion, and trifluoromethanesulfonate ion. Further, ionic polymers or another dye having a charge opposite to that of the sensitizing dye may be employed. In the invention, a sulfo group is denoted as $SO_3^-$, or may also be denoted as $SO_3H$ when it contains a hydrogen ion as a counter ion.

In the formulas, m1, m2 and m3 each represent a number necessary to counterbalance a charge in the dye molecule, which is 0 when forming an intramolecular salt, and preferably 0 to 4.

At least one of $Z_1$, $Z_2$, $Z_3$, $R_1$, $R_2$, $R_3$, and $L_1$ through $L_9$ of formula (2), or at least one of $Z_4$, $Z_5$, $Z_6$, $R_5$, $R_6$ and $L_{10}$ through $L_{15}$ of formula (3) is substituted preferably by a thio-ether group. The thio-ether group include any types of thio-ether groups. In this case, an alkylthio group, arylthio group or heterocycle-thio group may be attached to one of $Z_1$ to $Z_6$ or $L_1$ to $L_{15}$.

The thioether group may be-represented by the following formula (X):

formula (X)

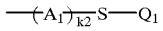

wherein $A_1$ represents an alkylene group, an alkenylene group, an alkynylene group or a heterocyclic bivalent group; k2 is 0 or 1; Q1 is the same as defined in Q. Exemplarily, $A_1$ include alkylenes(e.g., methylene, ethylene, propylene, butylenes, pentylene), arylenes (e.g., phenylene, naphthylene), alkenylenes (e.g., ethenylene, propenylene), alkynylenes (e.g., ethynylene, propionylene) and bivalent heterocyclic groups (e.g., 6-chloro-1,3,5-triazine-2,4-diyl, pyrimidine-2,4-diyl, quinoxaline-2,3-diyl). The se groups may be substituted, for example, by a substituent such as V described above.

Q or $Q_1$ is the same as defined in $R_2$, including an unsubstituted alkyl group preferably having 1 to 18 carbon atoms, more preferably 1 to 7, and still more preferably 1 to 4 carbon atoms (e.g., methyl, ethyl, propyl, isopropyl, butyl, isobutyl, hexyl, octyl, dodecyl, octadecyl); and a substltuted alkyl group preferably having 1 to 18 carbon atoms, more preferably 1 to 7, and still more preferably 1 to 4 carbon atoms, in which substituents include those as defined in V described above. Preferred examples of the substituted alkyl group include an aralkyl group (e.g., benzyl, 2-phenylethyl), unsaturated hydrocarbon group (e.g., allyl), hydroxyalkyl group (e.g., 2-hydroxyethyl, 3-hydroxypropyl), carboxyalkyl group (e.g., 2-carboxyethyl, 3-carboxypropyl, 4-carboxybutyl, carboxymethyl), alkoxyalkyl group (e.g., 2-methoxyethyl, 2-(2-methoxyethoxy)ethyl), aryloxyalkyl group (e.g., 2-phenoxyethyl, 2-(1-naphthoxy)ethyl), alkylthioalkyl group (e.g., 2-methylthioethyl, 2-(2-methylthioethylthio)ethyl), arylthioalkyl group (e.g., 2-phenylthioethyl, 2-(1-naphthyl)ethyl), heterocyclylthioalkyl group (e.g., 2-pyridylthioethyl, 2-thienylthioethyl), alkoxycarbonylalkyl group (e.g., ethoxycarbonylmethyl, 2-benzyloxycarbonylethyl), aryloxycarbonylalkyl group (e.g., 3-phenoxycarbonylpropyl), acyloxyalkyl group (e.g., 2-acetyloxyethyl), acylalkyl group (e.g., 2-acetylethyl), carbamoylalkyl group (e.g., 2-morpholinocarbonylethyl), sulfamoylalkyl group (e.g., 2-sulfoethyl, 3-sulfopropyl, 3-sulfobutyl, 4-sulfobutyl, 2-(3-sulfopropoxy)ethyl, 2-hydroxy-3-sulfopropyl, 3-sulfopropoxyethoxyethyl), sulfoalkenyl group (e.g., sulfopropenyl), sulfatoalkyl group (e.g., 2-sulfatoethyl, 3-sulfatopropyl, 4-sulfatobutyl), heterocycle-substituted alkyl group (e.g., 2-pyrolidine-2-one-1-yl)ethyl, tetrahydrofurfuryl).

The aryl group include an unsubstituted aryl group preferably having 6 to 20 carbon atoms, more preferably 6 to 10, and still more preferably 6 to 8 carbon atoms (e.g., phenyl, 1-naphthyl) and substituted aryl group preferably having 6 to 20 carbon atoms, more preferably 6 to 10, and still more preferably 6 to 8 carbon atoms (e.g., aryl groups substituted by V as defined as a substituent in $Z_1$, such as p-methoxyphenyl, p-methylphenyl, or p-chlorophenyl). The heterocyclic group include an unsubstituted heterocyclic group having preferably 1 to 20 carbon atoms, more preferably 3 to 10 carbon atoms, and still more preferably 4 to 8 carbon atoms (e.g., 2-furyl, 2-thienyl, 2-pyridyl, 3-pyrazolyl, 3-isooxazolyl, 3-isothiazolyl, 2-imidazolyl, 2-oxazolyl, 2-thiazolyl, 2-pyridadyl,2-pyrimidyl, 3-pyrazyl, 2-(1,3,5-triazolyl), 3-(1,2,4-triazolyl), 5-tetrazolyl) and substituted heterocyclic groups having preferably 1 to 20 carbon atoms, more preferably 3 to 10 carbon atoms, and still more preferably 4 to 8 carbon atoms (e.g., heterocyclic groups substituted by V as defined as a substituent in $Z_1$, such as 5-methyl-2-thienyl, 4-methoxy-2-pyridyl).

Of these, the alkyl groups and aryl groups described above are preferred, and an unsubstituted alkyl group (e.g., methyl, ethyl) and an unsubstituted aryl group (e.g., phenyl, naphthyl) are specifically preferred. The substituting position of the thioether group represented by formula (X) is preferably $Z_1$, $Z_2$, $Z_3$, $R_1$, $R_2$, $R_3$, $Z_4$, $Z_5$, $Z_6$, $R_4$, $R_5$ or $R_6$, more preferably $Z_1$, $Z_2$, $Z_3$, $Z_4$, $Z_5$ or $Z_6$, and still more.preferably $Z_1$, $Z_2$ or $Z_3$; and k1 is preferably 1 or 2.

The heterocyclic ring represented by $Z_9$ or S–Q is preferably represented as follows:

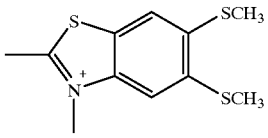

Of methine dyes represented by formula (4), a sensitizing dye represented by the following formula (5) is preferred:

formula (5)

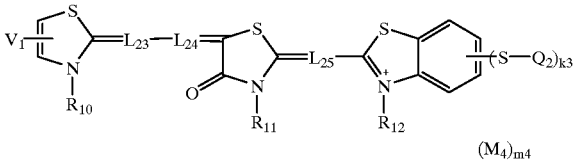

wherein $Q_2$ is the same as defined in Q; k3 is the same as defoned in k1; $R_{10}$ is the same as defined in $R_1$ of formula (2); $R_{11}$ is the same as defined in $R_2$ of formula (2); $R_{12}$ is the same as $R_3$ of formula (2); $L_{23}$ is the same as $L_3$ in formula (2); $L_{24}$ is the same as defined in $L_4$ of formula (2); $L_{25}$ is the same as defined in $L_5$ of formula (2); $M_4$ is the same as defined in $M_1$ of formula (2); m4 is the same as defined in m1 of formula (2); and $V_1$ represents a substituent, including the same one as defined in V.

Exemplary examples of compounds represented by formulas (2), (3), (4) and (5) are shown below, but are not limited to these.

D-29
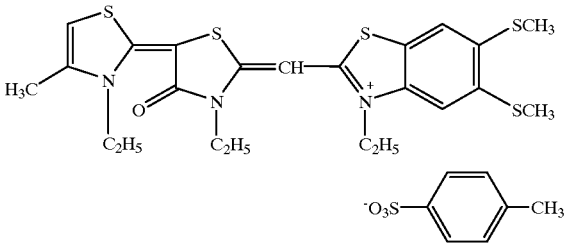
D-30
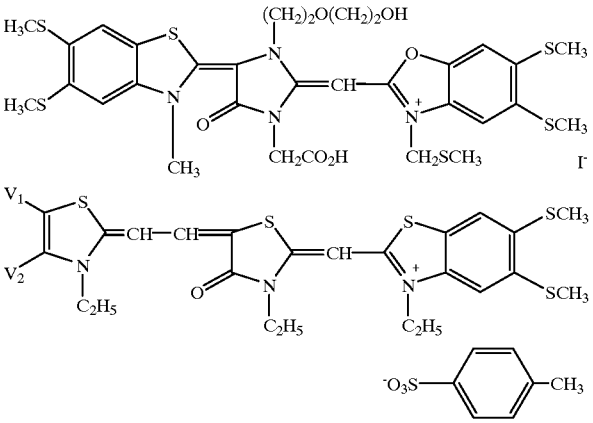
D-31
$V_1$ = H, $V_2$ = $CH_3$
D-32
$V_1$,$V_2$ = —$(CH_2)_4$—
D-33
$V_1$,$V_2$ = —$(CH_2)_3$—
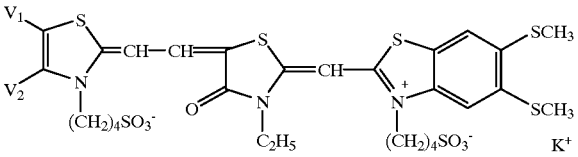
D-34
$V_1$ = H, $V_2$ = $CH_3$
D-35
$V_1$,$V_2$ = —$(CH_2)_4$—
D-36
$V_1$,$V_2$ = —$(CH_2)_3$—
D-37
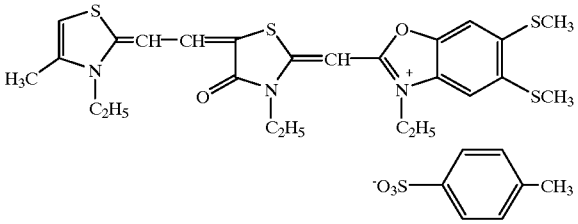
D-38
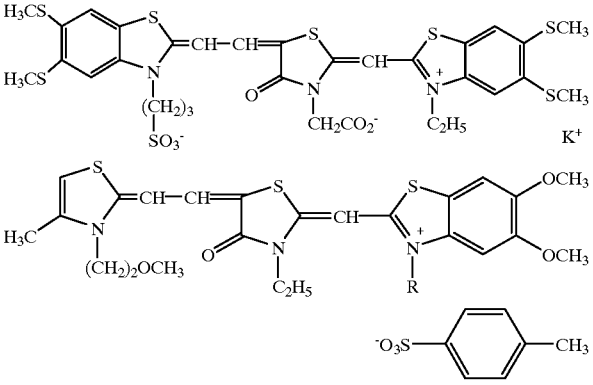
D-39
R = —$(CH_2)_2SCH_3$
D-40
R = —$(CH_2)_2S$—
D-41
R = —$(CH_2)_2S$—
D-42
R = —$(CH_2)_3S$—

-continued
D-43
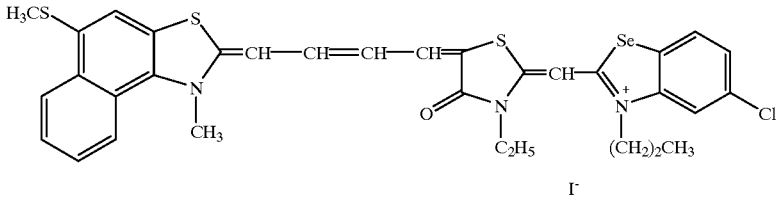
D-44
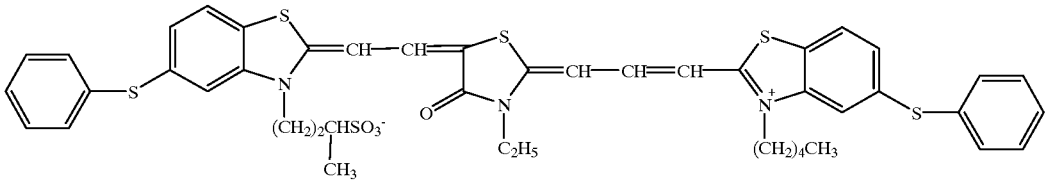
D-45
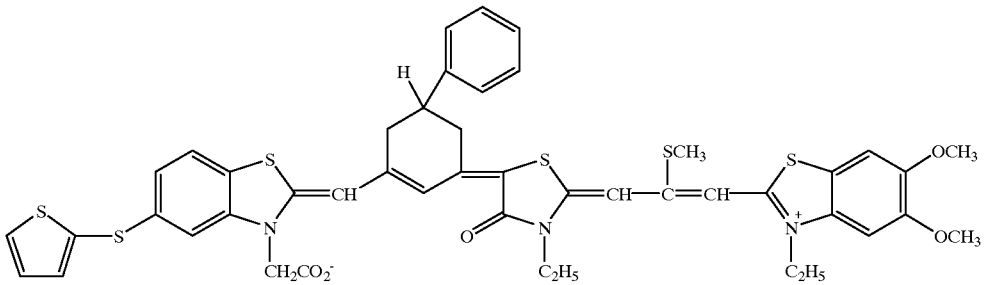
D-46
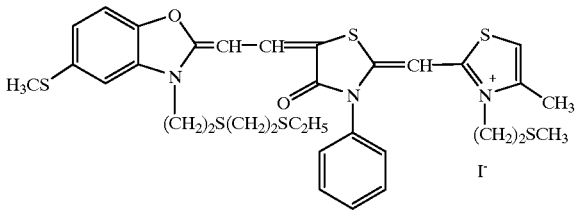
D-47
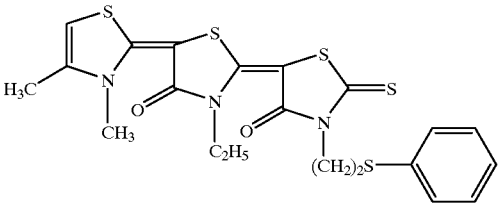
D-48
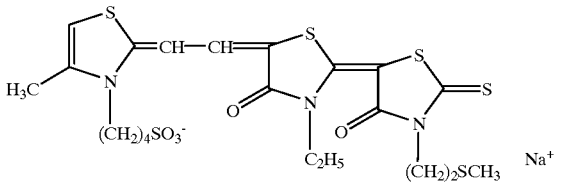
D-49
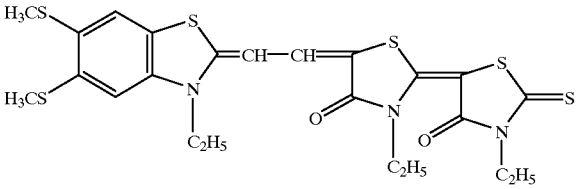
D-50
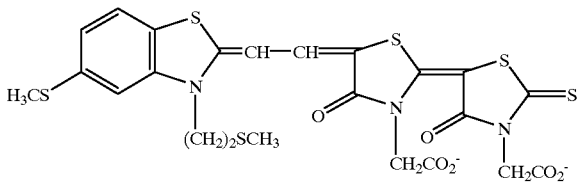
D-51
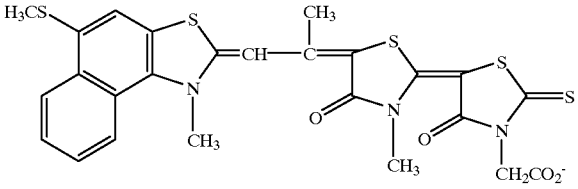
D-52
D-53

-continued
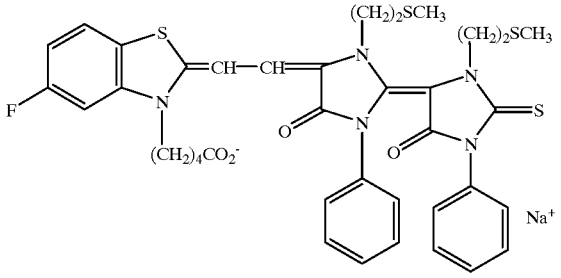
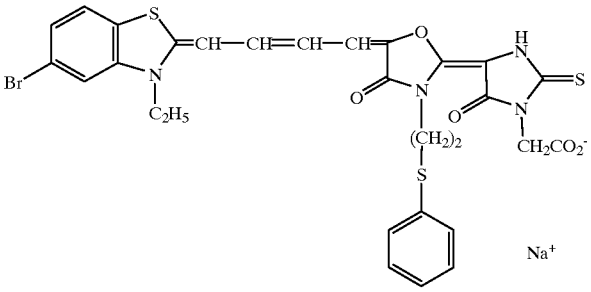
D-54
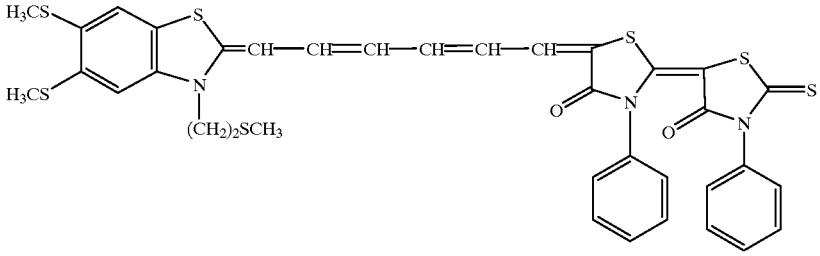
D-55
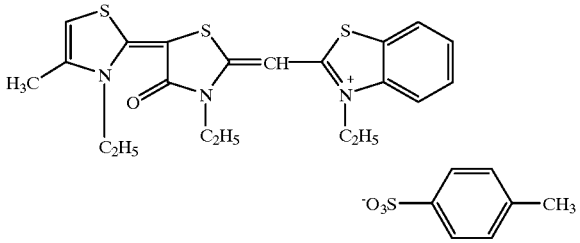
D-56
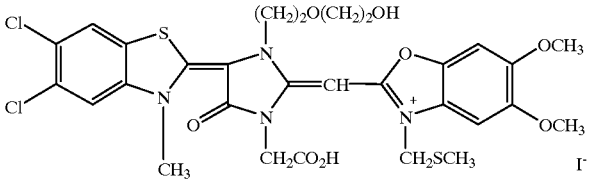
D-57
$V_1$ = H, $V_2$ = $CH_3$
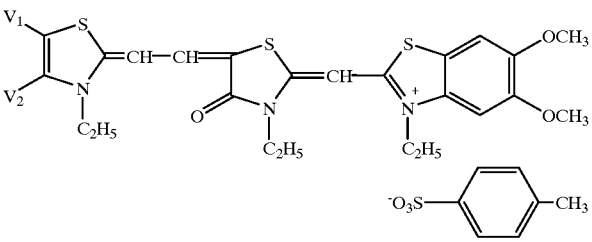
D-58
$V_1$,$V_2$ = ——$(CH_2)_4$——
$V_1$,$V_2$ = ——$(CH_2)_3$——
D-59
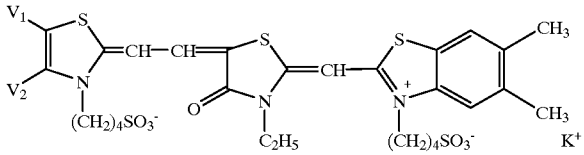
D-60
$V_1$ = H, $V_2$ = $CH_3$
D-61
$V_1$,$V_2$ = ——$(CH_2)_4$——
D-62
$V_1$,$V_2$ = ——$(CH_2)_3$——

-continued
D-63
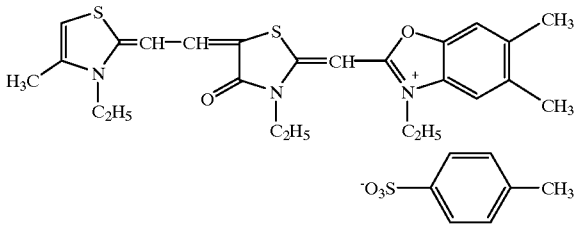
D-64
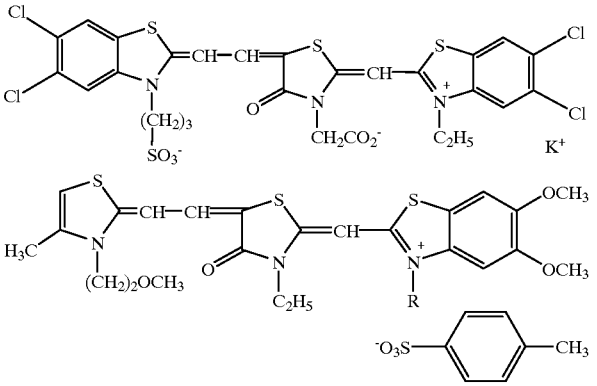
D-65
R = $-(CH_2)_2OCH_3$
D-66
R = $-(CH_2)_2O-$ 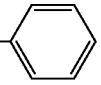
D-67
R = $-(CH_2)_2O-$ 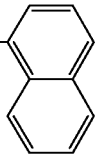
D-68
R = $-(CH_2)_3O-$ 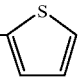
D-69
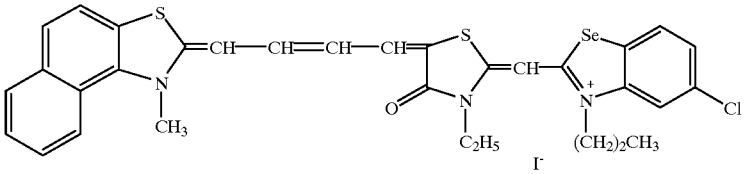
D-70
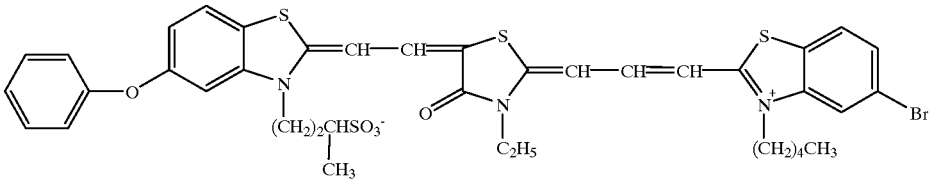
D-71
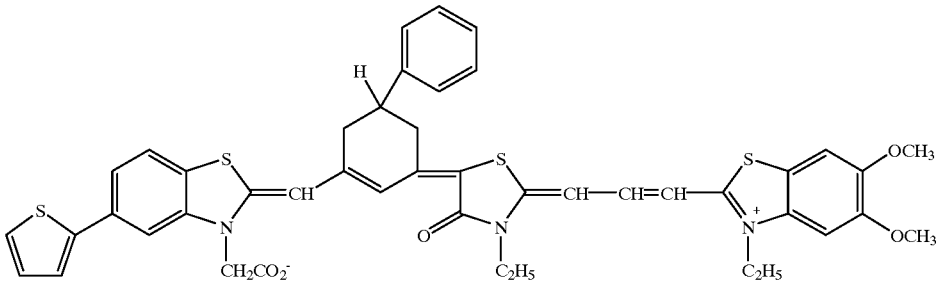
D-72
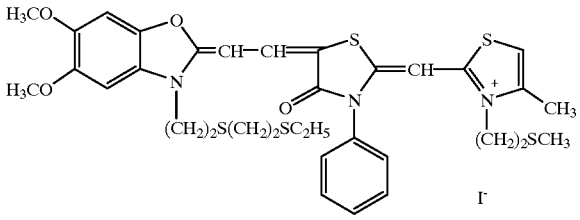
D-73
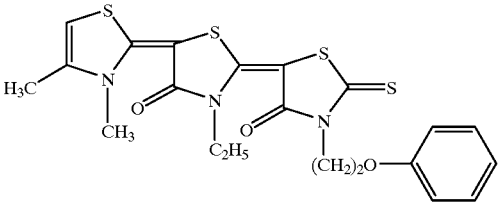

-continued

D-74

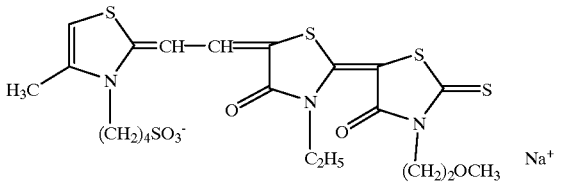

D-75

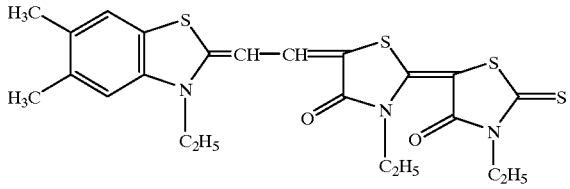

D-76

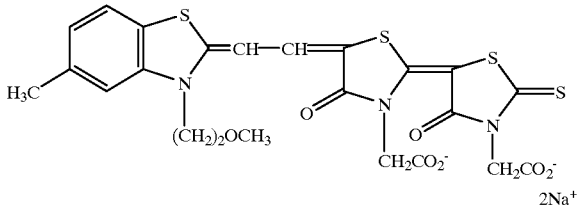

D-77

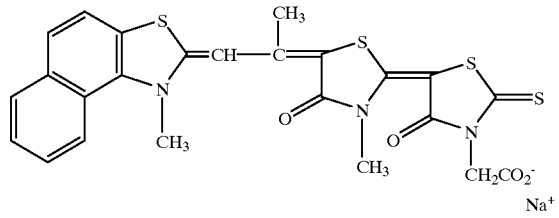

D-78

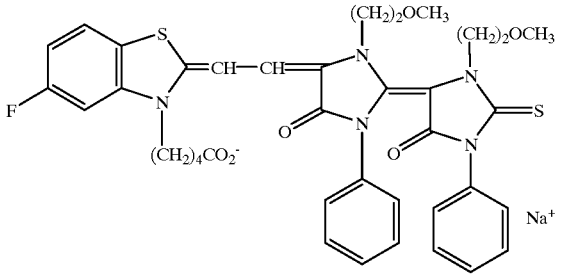

D-79

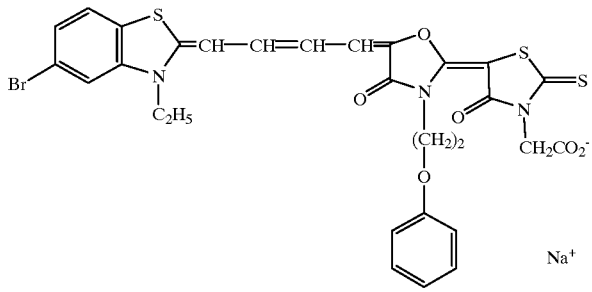

D-80

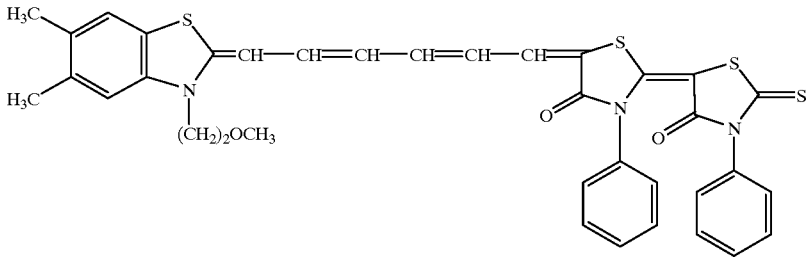

The compounds represented by formulas (2), (3), (4) and (5) can be synthesized with reference to F. M. Hamer, "Cyanine Dyes and Related Compounds" in The Chemistry of Heterocyclic Compounds Vol. 18 (Interscience, New York, 1964); D. M. Sturmer, "Heterocyclic Compounds, Special Topic in The Chemistry of Heterocyclic Compounds" Chapter 18, Sect. 14 pages 482–515 (John Wirey & Sons, New York, 1977); Rodd's Chemistry of Carbon Compounds, 2nd ed. Vol. 5, part B, 1977, Chapter 15, page 369–422, (published by Elsevier Science Publishing Company Inc., New York).

SYNTHESIS EXAMPLE 1

Spectral sensitizing dye D-31 can be synthesized according to the following scheme:

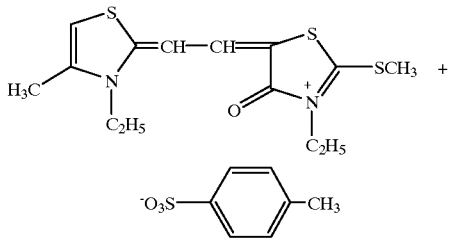

(a)

-continued

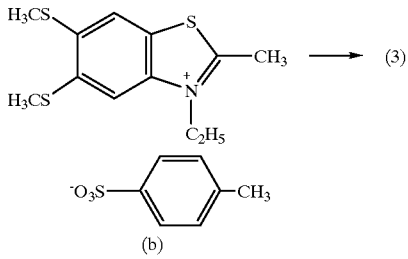

(3)

(b)

To a mixture of (a) of 0.9 g (0.0018 mol), (b) of 0.8 g (0.0018 mole) and acetonitrile of 20 m1 was added 0.5 m1 of ethylamine and heated on a water bath for 30 min. with stirring. The reaction mixture was cooled with water, while stirring and the resulting precipitates were filtered through suction filtration. The precipitates were refluxed in 50 ml methanol/50 ml chroloform with heating. After filtration, 50 ml of the solvent was distilled out. After being allowed to stand, precipitated crystals were filtered through suction filtration and dried under reduced pressure: D-31 (blue powder, yield of 0.87 g (67%), λmax=661 nm, ϵ=94300 (methanol), and m.p. of higher than 250° C.).

Silver halide photothermographic material according to the invention comprises a support having one side thereof a light-sensitive layer containing light-sensitive silver halide, which is spectrally sensitized with a sensitizing dye represented by formula (1), (2) or (3), exhibiting superior photographic performance with high sensitivity and reduced fog, little lowering of photographic performance after storage and improved image lasting quality and image tone.

When a water-resistant protective layer was not provided, deteriorated photographic performance such as zm increased fogging and reduced sensitivity was marked. Further, lowering of photographic performance after aging, such as reduced sensitivity after aging was marked, leading to deteriorated image lasting quality and deteriorated image tone.

Effects of the invention can be further enhanced by incorporating the sensitizing dye of formula (1), (2) or (3) into a light-sensitive silver halide emulsion. Spectral sensitizing dyes of formulas (1), (2), (3), (4) and (5) can be used alone or in combination thereof. In cases when used alone or in combination, the total amount of the dye(s) is preferably $1\times10^{-6}$ to $5\times10^{-3}$ mol, preferably $1\times10^{-5}$ to $2.5\times10^{-3}$ mol, and still more preferably $4\times10^{-5}$ to $1\times10^{-3}$ mol per mol of silver halide of a silver halide emulsion.

In cases when dyes are used in combination, the dyes can be incorporated in any proportion. The dye may be directly dispersed in a silver halide emulsion. Alternatively, the may be dissolved in an appropriate solvent such as methanol, ethanol, n-propanol, methyl cellosolve, acetone, water, pyridine, or a mixture thereof and added to the emulsion in the form of a solution. Ultrasonic can also be employed.

In cases when used in combination, the dyes can be independently or in the form of a mixture dispersed in a silver halide emulsion. Together with the dye(s), a visible region-absorbing dye capable of exhibiting supersensitization, a dye not exhibiting supersensitization, or a compound-having no absorption in the visible region may be incorporated into the emulsion. Usable sensitizing dyes and substances exhibiting supersensitization in combination with the dye are described in Research Disclosure (hereinafter, also denoted as "RD") vol. 176, item 17643 (December, 1978) page 23, section IV-J; JP-B 49-15500 and 43-4933; and JP-A 59-19032, 3-15049 and 62-123454.

Photosensitive silver halide emulsions usable in the thermally developable photosensitive materials according to the invention can be prepared according to the methods commonly known in the photographic art, such as single jet or double jet addition, or ammoniacal, neutral or acidic precipitation. Thus, the silver halide emulsion is prepared in advance and then the emulsion is mixed with other components of the invention to be incorporated into the composition used in the invention. To sufficiently bring the photosensitive silver halide into contact with an organic silver salt, there can be applied such techniques that polymers other than gelatin, such as polyvinyl acetal are employed as a protective colloid in the formation of photosensitive silver halide, as described in U.S. Pat. Nos. 3,706,564, 3,706,5653, 713,833 and 3,748,143, British Patent 1,362,970; gelatin contained in a photosensitive silver halide emulsion is degraded with an enzyme, as described in British Patent 1,354,186; or photosensitive silver halide grains are prepared in the presence of a surfactant to save the use of a protective polymer, as described in U.S. Pat. No. 4,076,539.

Silver halide used in the invention functions as light sensor. Silver halide grains are preferably small in size to prevent milky-whitening after image formation and obtain superior images. The grain size is preferably not more than 0.1 μm, more preferably, 0.01 to 0.1 μm, and still more preferably, 0.02 to 0.08 μm. The form of silver halide grains is not specifically limited, including cubic or octahedral, regular crystals and non-regular crystal grains in a spherical, bar-like or tabular form. Halide composition thereof is not specifically limited, including any one of silver chloride, silver chlorobromide, silver iodochlorobromide, silver bromide, silver iodobromide, and silver iodide. The halide composition of the grains may be homogeneous, or stepwise or continuously varied in the interior of the grain. Silver halide grains used in the photothermographic material are preferably contain iodide, in the vicinity of the grain surface, of 0.1 to 10 mol % on the average, based on the total grains.

Light-sensitive silver halide used in the photothermographic material of the invention can be formed simultaneously with the formation of organic silver salt by allowing a halide component such as a halide ion to concurrently be present together with organic silver salt-forming components and further introducing a silver ion thereinto during the course of preparing the organic silver salt.

Alternatively, a silver halide-forming component is allowed to act onto a pre-formed organic silver salt solution or dispersion or a sheet material containing an organic silver salt to convert a part of the organic silver salt to light-sensitive silver halide. The thus formed silver halide is effectively in contact with the organic silver salt, exhibiting favorable actions. In this case, the silver halide-forming component refers to a compound capable of forming silver salt upon reaction with the organic silver salt. Such a compound can be distinguished by the following simple test. Thus, a compound to be tested is to be mixed with the organic silver salt, and if necessary, the presence of a peal specific to silver halide can be confirmed by the X-ray diffractometry, after heating. Compounds that have been confirmed to be effective as a silver halide-forming component include inorganic halide compounds, onium halides, halogenated hydrocarbons, N-halogeno compounds and other halogen containing compounds. These compounds are detailed in U.S. Pat. Nos. 4,009,039, 3,457,075 and 4,003,749, British Patent 1,498,956 and JP-A 53-27027 and 53-25420. Exemplary examples thereof are shown below:

(1) Inorganic halide compound: e.g., a halide compound represented by formula, MXn, in which M represents H, NH4 or a metal atom; n is 1 when M is H or NH4 and a number equivalent to a valence number of the metal atom when M is the metal atom; the metal atom includes lithium, sodium, potassium, cesium, magnesium, calcium, strontium, barium, zinc, cadmium, mercury, tin, antimony, chromium, manganese, cobalt, rhodium, and cerium, and molecular halogen such as aqueous bromine being also effective;

(2) Onium halide: e.g., quaternary ammonium halides such as trimethylphenylammonium bromide, cetylethyldimethylammonium bromide, and trimethylbenzylammonium bromide; and tertiary sulfonium halides such as trimethylsulfonium iodide;

(3) Halogenated hydrocarbons: e.g., iodoform, bromoform, carbon tetrachloride and 2-brom-2-methylpropane;

(4) N-halogeno compounds: e.g., N-chlorosuccinimide, N-bromosucciimde, N-bromophthalimide, N-bromoacetoamide, N-iodosuccinimide, N-bromophthalazinone, N-bromooxazolinone, N-chlorophthalazinone, N-bromoacetoanilide, N,N-dibromobenzenesulfonamide, N-bromo-N-methylbenzenesulfonamide, 1,3-dibromo-4,4-dimethylhydantoin and N-bromourazole;

(5) Other halogen containing compounds: e.g., triphenylmethyl chloride, triphenylmethyl bromide 2-bromoacetic acid, 2-bromoethanol and dichlorobenzophenone.

The silver halide forming component is used stoichiometrically in a small amount per organic silver salt. Thus, it is preferably 0.001 to 0.7 mol, and more preferably 0.03 to 0.5 mol per mol of organic silver salt. The silver halide-forming component may be used in combination. Conditions including a reaction temperature, reaction time andstreaction pressure during the process of converting a part of the organic silver salt to silver halide using the silver halide forming component can be appropriately set in accordance wit h the purpose of preparation. The reaction temperature is preferably −20° C. to 70° C., the reaction time is preferably 0.1 sec to 72 hrs. and the reaction pressure is preferably atmospheric pressure. The reaction is performed preferably in the presence of polymer as a binder, wherein the polymer to be used is preferably 0.01 t o 100 weight parts, and more preferably 0.1 to 10 weight parts per i weight part of an organic silver salt.

The thus formed light-sensitive silver halide can be chemically sensitized with a sulfur containing compound, gold compound, platinum compound,palladium compound, silver compound, tin compound, chromium compound or their combination. The method and procedure for chemical sensitization are described in U.S. Pat. No. 4,036,650, British Patent 1,518,850, JP-A 51-22430, 51-78319 and 51-81124. As described in U.S. Pat. No. 3,980,482, a low molecular weight amide compound may be concurrently present to enhance sensitivity at the time of converting a part of the organic silver salt to photo sensitive silver halide.

To improve reciprocity law failure or adjust contrast, the photosensitive silver halide may be contained with metal ions of the 6th group to 10th group in the periodical table, such as Rh, Ru, Re, Ir, Os, Fe and their complexes and complex ions. Specifically, complex ions are preferred, e.g., Ir complex ions such as $IrCl_6^{2-}$ are preferably contained to improve reciprocity law failure.

The light-sensitive layer of the photothermographic material used in the invention preferably contains binder, which is mainly comprised of polymeric latex. Herein, the polymeric latex is a water-insoluble polymeric material which is dispersed in an aqueous dispersing medium in the form of fine particles. The dispersion form thereof may be any one of a form in which a polymer is emulsified in a dispersing medium, a form of being emulsion-polymerized, being dispersed in the form of a micell and a form in which a polymer has a hydrophilic partial structure and its molecular chain is in the form of a molecular dispersion. The polymeric latexes are described in "Synthetic Resin Emulsion" (edited by T. Okuda and h. Inagaki, published by KOBUNSHI-90OK), 1978), "Application of Synthetic Latex" (edited by Sugimura et al., published by KOBUNSHI-KANOKAI, 1993), and "Chemistry of Synthetic Latex" (S. Muroi, published by KOBUNSHI-KANOKAJ, 1970).

The mean particle size of dispersing particles is 1 to 50,000 nm, and preferably 5 to 1,000 nm. The particle size distribution thereof is not specifically limited and may be polydisperse or monodisperse. The polymeric latexes used in the invention may be those having a uniform structure as well as core/shell type latexes. In this case, it is sometimes preferred that the glass transition temperature is different between the core and shell. The minimum forming (or tarnishing) temperature (MFT) of the polymeric latexes is preferably −30° C. to 90° C., and more preferably 0° C. to 70° C. A tarnishing aid is also called a plasticizer, which is an organic compound (conventionally, an organic solvent) capable of lowering the MFT of a polymeric latex and described in "Chemistry of Synthetic Latex" (S. Muroi, published by KOBUNSHI-KANKOKAI, 1970).

Polymers used for polymeric latexes include acryl resin, vinyl acetate resin, polyester resin, polyurethane resin, rubber type resin, vinyl chloride resin, vinylidene chloride resin, polyolefin resin and their copolymers. Polymers may be a straight-chained polymer or branched polymer, or a cross-linked polymer, including homopolymers and copolymers. The copolymer may be a random copolymer or a block copolymer. The number-averaged molecular weight of the copolymer is preferably 5,000 to 1000,000, and more preferably 10,000 to 100,000. In cases where the molecular weight is excessively small, mechanical strength of an image forming layer such as a light-sensitive layer is insufficient, excessively large molecular weight results in deterioration in film forming property. Polymers used for polymeric latexes preferably has an equilibrium moisture content of not more than 2 wt %, and more preferably 1 wt % or less at 25° C. and 60% RH. The lower limit of the equilibrium moisture content is not specifically limited, but preferably 0.01 wt %, and more preferably 0.03 wt %. Definition and measurement of the equilibrium moisture content is detailed in "Polymer Material Testing Method" in Polymer Engineering Series vol.14 (edited by KOBUNSHI-GAKKAI, published by CHJINSHOKAN).

Exemplary examples of polymeric latexes used as binder include a latex of methylmethacrylate/ethylmethacrylate/methacrylic acid copolymer, a latex of methylmethacrylate/2-ethylhexylacrylate/styrene/acrylic acid copolymer, a latex of styrene/butadiene/acrylic acid copolymer, a latex of styrene/butadiene/divinylbenzene/methacrylic acid copolymer, a latex of methylmethacrylate/vinyl chloride/acrylic acid copolymer, and a latex of vinylidene chloride/ethylacrylate/acrylonitrile/methacrylic acid copolymer. Such polymers are commercially available, and examples of commercially available acryl resin include Sevian A-4635, 46583, and 4601 (available from DAISEL CHEMICAL INd. Ltd.)Nipol Lx811, 814, 821, 820, and 857 (available from NIHON ZEON Co. Ltd. Examples of polyester rein include FINETEX ES650, 611, 675, 850 (available from DAINIPPON INK CHEMICAL Co. Ltd.), and WD-size WMS (available from Eastman Kodak Corp.). Examples of polyurethane resin include HYDRAN AP10, 20, 30, 40

(available from DAINIPPON INK CHEMICAL Co. Ltd.). Examples of rubber resin include LACSTAR 7310K, 3307, 4700H, 7132C (available from DAINIPPON INK CHEMICAL Co. Ltd.); and Nipol Lx416, 410, 438C and 2507 (available from NIHON ZEON Co. Ltd.). Examples of vinylidene chloride resin include L502, L513 (available from ASAHI CHEMICAL IND. Co. Ltd.). Examples of olefin resin include CHEMIPAL s120, SA100 (available from MITSUI PETROLEUM CHEMICAL IND. Co. Ltd.).

These polymers can be used alone or may be blended. In the invention, the main binder in the light-sensitive layer, alternatively, the expression of the binder, which is mainly comprised of polymeric latex means that preferably, at least 50 wt %, and more preferably at least 70 wt % of the whole binder in the light-sensitive layer is accounted for by the polymer, i.e., polymeric latex used in the invention. The binder may be a polymer alone or blended polymers. In addition to the polymeric latex, hydrophilic polymers such a s gelatin polyvinyl alcohol, methyl cellulose or hydroxypropyl cellulose may be optionally incorporated into the light-sensitive layer (or emulsion layer). The hydrophilic polymer is incorporated preferably in an amount of not more than 30 wt %, and more preferably not more than 20 wt % of the whole binder. The ratio by weight of the whole binder to silver halide in the light-sensitive layer is preferably 5 to 400, and more preferably 10 to 200.

Organic silver salts used in the invention are reducible silver source, and silver salts of organic acids or organic heteroacids are preferred and silver salts of long chain fatty acid (preferably having 10 to 30 carbon atom and more preferably 15 to 25 carbon atoms) or nitrogen containing heterocyclic compounds are more preferred. Specifically, organic or inorganic complexes, ligand of which have a total stability constant to a silver ion of 4.0 to 10.0 are preferred. Exemplary preferred complex salts are described in RD17029 and RD29963, including organic acid salts (for example, salts of gallic acid, oxalic acid, behenic acid, stearic acid, palmitic acid, lauric acid, etc.); carboxyalkyithiourea salts (for example, 1-(3-carboxypropyl) thiourea, 1-(3-caroxypropyl)-3,3-dimethylthiourea, etc.); silver complexes of polymer reaction products of aldehyde with hydroxy-substituted aromatic carboxylic acid (for example, aldehydes (formaldehyde, acetaldehyde, butylaldehyde, etc.), hydroxy-substituted acids (for example, salicylic acid, benzoic acid, 3,5-dihydroxybenzoic acid, 5,5-thiodisalicylic acid, silver salts or complexes of thiones (for example, 3-(2-carboxyethyl)-4-hydroxymethyl-4-(thiazoline-2-thione and 3-carboxymethyl-4-thiazoline-2-thione), complexes of silver with nitrogen acid selected from imidazole, pyrazole, urazole, 1,2,4-thiazole, and 1H-tetrazole, 3-amino-5-benzylthio-1,2,4-triazole and benztriazole or salts thereof; silver salts of saccharin, 5-chlorosalicylaldoxime, etc.; and silver salts of mercaptides. Of these organic silver salts, silver salts of fatty acids are preferred, and silver salts of behenic acid, arachidic acid and stearic acid are specifically preferred.

The organic silver salt compound can be obtained by mixing an aqueous-soluble silver compound with a compound capable of forming a complex. Normal precipitation, reverse precipitation, double jet precipitation and controlled double jet precipitation described in JP-A 9-127643 are preferably employed. For example, to an organic acid is added an alkali metal hydroxide (e.g., sodium hydroxide, potassium hydroxide, etc.) to form an alkali metal salt soap of the organic acid (e.g., sodium behenate, sodium arachidinate, etc.). thereafter, the soap and silver nitrate are mixed by the controlled double jet method to form organic silver salt crystals. In this case, silver halide grains ma y be concurrently present.

In the present invention, organic silver salts have an average grain size of 2 $\mu$m or less and are monodispersed. The average size of the organic silver salt as described herein is, when the grain of the organic salt is, for example, a spherical, cylindrical, or tabular grain, a diameter of the sphere having the same volume as each of these grains, i.e., a sphere-equivalent diameter. The average grain size is preferably between 0.05 and 1.5 $\mu$m, more preferably between 0.05 and 1.0 $\mu$m and still more preferably between 0.05 and 0.5 $\mu$m. Furthermore, the monodisperse as described herein is the same as silver halide grains and preferred monodispersibility is between 1 and 30%.

It is also preferred that at least 60% of the total of the organic silver salt is accounted for by tabular grains. The tabular grains refer to grains having a ratio of an average grain diameter to grain thickness, i.e., aspect ratio (denoted as AR) of 3 or more:

AR=average diameter ($\mu$m)/thickness ($\mu$m)

To obtain such tabular organic silver salts, organic silver salt crystals are pulverized together with a binder or surfactant, using a ball mill. Thus, using those tabular grains, photosensitive materials exhibiting high density and superior image fastness are obtained.

The silver salts used in the invention may be employed in the form of powder or wet cake.

To prevent hazing of the photosensitive material, the total amount of silver halide and organic silver salt is preferably 0.5 to 2.2 g in equivalent converted to silver per $m^2$, leading to high contrast images. The amount of silver halide is preferably 50% by weight or less, more preferably 25% by weight or less, and still more preferably 0.1 to 15% by weight, based on the total silver amount.

Commonly known-reducing agents are used in phtothermographic materials, including phenols, polyphenols having two or more phenols, naphthols, bisnaphthols, polyhydoxybenzenes having two or more hydroxy groups, polyhydoxynaphthalenes having two or more hydroxy groups, ascorbic acids, 3-pyrazolidones, pyrazoline-5-ones, pyrazo lines, phenylenediamines, hydroxyamines, hydroquinone monoethers, hydrooxamic acids, hydrazides, amidooximes, and N-hydroxyureas. Further, exemplary examples thereof are described in U.S. Pat. Nos. 3,615,533, 3,679,426, 3,672,904, 3,51,252, 3,782,949, 3,801,321, 3,794,488, 3,893,863, 3,887,376, 3,770,448, 3,819,382, 3,773,512, 3,839,048, 3,887,378, 4,009,039, and 4,021,240; British Patent 1,486,148; Belgian Patent 786,086; JP-A 50-36143, 50-36110, 50-116023, 50-99719, 50-140113, 51-51933, 51-23721, 52-84727; and JP-B 51-35851.

Of these reducing agents, in cases where fatty acid silver salts are used as an organic silver salt, preferred reducing agents are polyphenols in which two or more phenols are linked through an alkylene group or a sulfur atom, specifically, polyphenols in which two or more phenols are linked through an alkylene group or a sulfur atom and the phenol(s) are substituted at least a position adjacent to a hydroxy group by an alkyl group (e.g., methyl, ethyl, propyl, t-butyl, cyclohexyl) or an acyl group (e.g., acetyl, propionyl). Examples thereof include polyphenols compounds such as 1,1-bis(2-hydroxy-3,5-dimethylphenyl)-3,5,5-trimethylhexane, 1,1-bis(2-hydroxy-3-t-butyl-5-methyphenyl)methane, 1,1-bis(2-hydroxy-3,5-di-t-butylphenyl)methane, 2-hydroxy-3-t-butyl-5-methylphenyl)-(2-hydroxy-5-methylphenyl)methane, 6,6'-benzylidene-bis(2,4-di-t-butylphenol), 6,6'-benzylidene-bis(2-t-butyl-4-methylphenol), 6,6'-benzylidene-bis(2,4-dimethylphenol), 1,1-bis (2-hydroxy-3,5-dimethylphenyl)-2-methylpropane, 1,1,5,5-tetrakis(2-hydroxy-3,5-dimethyophenyl)-2,4-ethylpentane, 2,2-bis(4-hydroxy-3,5-dimethylphenyl) propane, 2,2-bis(4-hydroxy-3,5-di-t-butylphenyl)propane, as described in U.S. Pat. Nos. 3,589,903 and 4,021,249, British Patent 1,486,148, JP-A 51-51933, 50-36110 and 52-84727 and JP-B 51-35727; bisnaphthols described in U.S. Pat. No. 3,672,904, such as 2,2'dihydoxy-1,1'-binaphthyl, 6,6'-dibromo-2,2'-dihydroxy-1,1'-binaphthyl, 6,6'-dinitro-2,2'-dihydroxy-1,1'-binaphtyl, bis(2-hydroxy-1-naphthyl)methane, 4,4'-dimethoxy-1,1'-dihydroxy-2,2'-binaphthyl; sulfonamidophenols or sulfonamidonaphthols described in U.S. Pat. No. 3,801,321, such as 4-benzenesulfonaahidophenol, 2-benzenesulfonamidophenol, 2,6-dichloro-4-benzenesulfonamidophenol and 4-benzenesulfonamidonaphthol.

The amount of the reducing agent to be used in the thermally developable photosensitive material, depending on the kind of an organic silver salt or reducing agent is preferably 0.05 to 10 mol, and more preferably 0.1 to 3 mol per mmol of organic silver salt. Two or more kinds of reducing agents may be used in combination within the amount described above. It is also preferred to add the reducing agent to a photosensitive coating solution immediately before coating, in terms of reduced variation in photographic performance occurred during standing.

Thermally developable photothermographic materials form images through thermal development and comprise a reducible silver source (organic silver salt), a light-sensitive silver halide, a reducing agent and optionally a toning agent for silver images, which are preferably dispersed in a (organic) binder matrix. The thermally developable photosensitive material according to the invention, which is stable at ordinary temperatures, is exposed and then heated at a high temperature (e.g., 80–140° C.) to undergo development. Thus, silver is formed on heating through oxidation-reduction reaction between an organic silver salt (functioning as an oxidizing agent) and a reducing agent. The oxidation-reduction reaction is catalytically accelerated by a latent image produced in silver halide upon exposure. Silver formed through reaction of the organic silver salt in exposed areas provides black images contrasting to non-exposed areas, performing image formation. This reaction process proceeds without supplying a processing solution such as water from the outside.

Image toning a gents are preferably incorporated into the thermally developable photosensitive material used in the present invention. Examples of preferred image toning agents are disclosed in Research Disclosure Item 17029, and include the following:

imides (for example, phthalimide), cyclic imides, pyrazoline-5-one, and quinazolinone (for example, succinimide, 3-phenyl-2-pyrazoline-5-on, 1-phenylurazole, quinazoline and 2,4-thiazolidione); naphthalimides (for example, N-hydroxy-1,8-naphthalimide); cobalt complexes (for example, cobalt hexaminetrifluoroacetate), mercaptans (for example, 3-mercapto-1,2,4-triazole); N-(aminomethyl) aryldicarboxyimides (for example, N-(dimethylaminomethyl)phthalimide); blocked pyrazoles, isothiuronium derivatives and combinations of certain types of light-bleaching agents (for example, combination of N,N'-hexamethylene(1-carbamoyl-3,5-dimethylpyrazole), 1,8-(3,6-dioxaoctane)bis-(isothiuroniumtrifluoroacetate), and 2-(tribromomethyl-sulfonyl)benzothiazole; merocyanine dyes (for example, 3-ethyl-5-((3-etyl-2-benzothiazolinylidene-(benzothiazolinylidene))-1-methylethylidene-2-thio-2,4-oxazolidinedione); phthalazinone, phthalazinone derivatives or metal salts thereof (for example, 4-(1-naphthyl)phthalazinone, 6-chlorophthalazinone, 5,7-dimethylphthalazinone, and 2,3-dihydro-1,4-phthalazinedione); combinations of phthalazinone and sulfinic acid derivatives (for example, 6-chlorophthalazinone and benzenesulfinic acid sodium, or 8-methylphthalazinone and p-trisulfonic acid sodium); combinations of phthalazine and phthalic acid; combinations of phthalazine (including phthalazine addition products) with at least one compound selected from maleic acid anhydride, and phthalic acid, 2,3-naphthalenedicarboxylic acid or o-phenylenic acid derivatives and anhydrides thereof (for example, phthalic acid, 4-methylphthalic acid, 4-nitrophthalic acid, and tetrachlorophthalic acid anhydride); quinazolinediones, benzoxazine, naphthoxazine derivatives, benzoxazine-2,4-diones (for example, 1,3-benzoxazine-2,4-dione); pyrimidines and asymmetry-triazines (for example, 2,4-dihydroxypyrimidine), and tetraazapentalene derivatives (for example, 3,6-dimercapto-1,4-diphenyl-1H,4H-2,3a,5,6a-tatraazapentalene). Preferred image color control agents include phthalazone or phthalazine.

An antifogging halogenated compound is preferably incorporated to bleach silver microcluster causing fog during preparation or storage of the thermally developable photosensitive material. Commonly known compounds bleaching silver microcluster are applicable to the present invention. Specifically, an aromatic compound substituted with at least one halogenated group is preferred, as represented by the following formula:

$$Ar—(SO_2)y—CH_{3-n}(X)n \qquad \text{formula (a)}$$

where y is 0 or 1, X is a halogen atom, n is 1,2 or 3 and Ar is an aromatic hydrocarbon group or an aromatic heterocyclic group. The compounds represented by formula (a) are exemplarily detailed in U.S. Pat. Nos. 4,546,075, 4,756,999, 4,452,885, 3,874,946 and 3,955,982. Other useful halogenated antifogging compounds, such as di-halogenated compounds are also described in JP-A 59-57234. The antifogging halogenated compound is preferably incorporated into a silver layer or top layer in an amount of $5\times10^{-4}$ to 0.5 mol, and more preferably $5\times10^{-3}$ to $5\times10^{-2}$ mol per mol of total silver.

As a compound capable of deactivating a reducing agent to inhibit reduction of an organic silver salt to silver by the reducing agent are preferred compounds releasing a labile species other than a halogen atom. However, these compounds may be used in combination with a compound capable of releasing a halogen atom as a labile species. The compound capable of releasing a halogen atom as a labile species is used preferably in an amount of 0.001 to 0.1 mol/m$^2$ and more preferably 0.005 to 0.05 mol/m$^2$. Exemplary examples of the compound releasing an active halogen atom include a compound represented by the following formula (6):

formula (6)

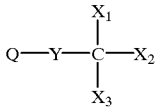

wherein Q is a n aryl group or a heterocyclic group; $X_1$, $X_2$ a nd $X_3$ are each a hydrogen atom, a halogen atom, a haloalkyl group, an acyl group, an alkoxycarbonyl group, an aryloxycarbonyl group, a sulfonyl group, an aryl group or a heterocyclic group, provided that at least of them a halogen atom; Y is —C(=O)—, —SC— or —$SO_2$—. The aryl group represented by Q may be a monocyclic group or condensed ring group and is preferably a monocyclic or di-cyclic aryl group having 6 to 30 carbon atoms (e.g., phenyl, naphthyl), more preferably a phenyl or naphthyl group, and still more preferably a phenyl group. The heterocyclic group represented by Q is a 3- to 10-membered, saturated or unsaturated heterocyclic group containing at least one of N, O and S, which may be a mnonocyclic or condensed with another ring to a condensed ring. The heterocyclic group is preferably a 5- or 6-membered unsaturated heterocyclic group, which mnay be condensed, more preferably a 5- or 6-membered aromatic heterocyclic group, which may be condensed, still more preferably a N-containing 5- or 6-membered aromatic heterocyclic group, which may be condensed, and optimally a 5- or 6-membered aromatic heterocyclic group containing one to four N atoms, which may be condensed. Exemplary examples of heterocyclic rings included in the heterocyclic group include imidazole, pyrazole, pyridine, pyrimidine, pyrazine, pyridazine, triazole, triazines, indole, indazole. purine, thiazole, oxadiazole, quinoline, phthalazine, naphthyridine, quinoxaline, quinazoline, cinnoline, pteridine, acrydine, phenanthroline, phenazine, tetrazole, thiazole, oxazole, benzimidazole, benzoxazole, benzthiazole, indolenine and tetrazaindene. Of these are preferred imidazole, pyridine, pyrimidine, pyrazine, pyridazine, triazole, triazines, thiadiazole, oxadiazole, quinoline, phthalazine, naphthylizine, quinoxaline, quinazoline, cinnoline, tetrazole, thiazole, oxazole, benzimidazole, and tetrazaindene; more preferably imidazole, pyrimidine, pyridine, pyrazine, pyridazine, triazole, triazines, thiadiazole, quinoline, phthalazine, naphthyridine, quinoxaline, quinazoline, cinnoline, tetrazole, thiazole, benzimidazole, and benzthiazole; and still more preferably pyridine, thiazole, quinoline and benzthiazole.

The aryl group or heterocyclic group represented by Q may be substituted by a substituent, in addition to —Y—C($X_1$)($X_2$)($X_3$). Preferred examples of the substituent include an alkyl group, an alkenyl group, an aryl group, an alkoxyl group, an aryloxyl group, an acyloxy group, an acyl group, an alkoxycarbonyl group, an aryloxycarbonyl group, an acyloxy group, an acylamino group, an alkoxycarbonylamino group, an aryloxycarbonylamino group, a sulfonylamino group, a sulfamoyl group, a carbamoyl group, a sulfonyl group, a ureido group, phosphoramido group, a halogen atom, cyano group, sulfo group, carboxy group, nitro group and heterocyclic group. Of these are preferred an alkyl group, an aryl group, an alkoxyl group, an aryloxyl group, an acyl group, an acylamino group, an aryloxyl group, acyl group, an acylamino group, an alkoxycarbonyl group, an aryloxycarbonylamino group, a sulfonylamino group, a sulfamoyl group, a carbamoyl group, a ureido group, phosphoramido group, a halogen atom, cyano group, nitro group, and a heterocyclic group; and more preferably an alkyl group, an aryl group, an alkoxyl group, an aryloxyl group, an acyl group, an acylamino group, a sulfonylamino group, a sulfamoyl group, a carbamoyl group, a halogen group, cyano group, nitro group and a heterocyclic group; and still more preferably an alkyl group, an aryl group and a halogen atom.

$X_1$, $X_2$ and $X_3$ are preferably a halogen atom, a haloalkyl group, an acyl group, an alkoxycarbonyl group, an aryloxycarbonyl group, a carbamoyl group, a sulfamoyl group, a sulfonyl group, and a heterocyclic group, more preferably a halogen atom, a haloalkyl group, an acyl group, an alkoxycarbonyl group, an aryloxycarbonyl group, and a sulfonyl group; and still more preferably a halogen atom and trihalomethyl group; and most preferably a halogen atom. Of halogen atoms are preferably chlorine atom, bromine and iodine atom, and more preferably chlorine atom and bromine atom, and still more preferably bromine atom. Y is —C(=O)—, —SO—, and —$SO_2$—, and preferably —$SO_2$—.

The photothermographic material comprises a) a non-photosensitive organic silver salt, b) a photosensitive silver halide, c) a reducing agent capable of reducing a silver ion of the organic silver salt when activated upon heating, d) a binder and e) a cross-linking agent for the binder. Concurrent presence of silver halide as a photoreceptor, the organic silver salt as a silver source and the reducing agent deteriorates pre-exposure storage stability of the photothermographic material. No fixation subsequent to development produces disadvantages in stability after being developed, such as occurrence of marked print-out when exposed to light. Such disadvantages are contemplated to be due to the fact that the presence of a reducing agent in the photosensitive material easily causes thermal fogging upon reaction with an organic silver salt and the reducing agent functions not only as reduction of a silver ion but also as a hole trap when exposed, after development, to light in the wavelength region different from that of the image recording light, promoting print-out of silver halide and the organic silver salt.

It was discovered that problems such as described above could be solved by incorporating a compound capable of generating a labile species, which deactivated the reducing agent on exposure to ultraviolet or visible radiation after thermal development to inhibit reduction of the silver halide and the organic silver salt. As a reducing agent used in photothermographic materials are employed reducing agents containing a proton, such as bisphenols and isulfonamidophenols. Accordingly, a compound generating a labile species which is capable of abstracting a proton to deactivate the reducing agent is preferred. More preferred is a compound as a non-colored photooxidizing substance, which is capable of generating a free radical as a labile species on exposure. Any compound having such a function is applicable. However, a halogen radical, which easily forms silver halide is not preferred. An organic free radical composed of plural atoms is preferred. Any compound having such a function and exhibiting no adverse effect on the photothermographic material is usable irrespective of its structure.

Of such free radical generation compounds, a compound containing an aromatic, and carbocyclic or heterocyclic group is preferred, which provides stability to the generated free radical so as to be in contact with the reducing agent for a period sufficient to react with the reducing agent to deactivate it. Representative examples of such compounds include biimidazolyl compounds and iodonium compounds. The imidazolyl compounds generate two imidazolyl radicals as a free radical upon exposure to ultraviolet or visible radiation, which are capable of oxidizing a reducing agent remaining after development, thereby inhibiting reduction of silver salts. It is surprising that the imidazolyl compound is photo-active and capable of oxidizing a reducing agent effective in heat-promoted reduction of a substantially non-photosensitive organic silver salt.

Of such imidazolyl compounds, a compound represented by the following formula (7) is preferred:

formula (7)

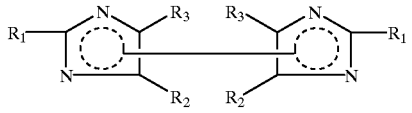

wherein $R_1$, $R_2$ and $R_3$ (,which may be the same or different) each are an alkyl group (e.g., methyl, ethyl, hexyl), an alkenyl group (e.g., vinyl, allyl), an alkoxyl group (e.g., methoxy, ethoxy, octyloxy), an aryl group (e.g., phenyl, naphthyl, tolyl), hydroxy, a hydrogen atom, a halogen atom, an aryloxyl (e.g., phenoxy), an alkylthio group (e.g., methylthio, butylthio), an arylthio group (e.g., phenylthio), a heterocyclic group (e.g., pyridyl, triazyl), an acyl group (e.g., acetyl, propionyl, butylyl, valeryl), a sulfonyl group (e.g., methylsulfonyl, phenylsulfonyl), an acylamino group, sulfonylamino group, an acyloxy group (e.g., acetoxy, benzoxy), carboxy, cyano, a sulfo group, or an amino group. Of these groups are preferred an aryl group, a heterocyclic group, an alkenyl group and cyano group.

The biimidazolyl compounds can be synthesized in accordance with the methods described in U.S. Pat. No. 3,734,733 and British Patent 1,271,177. Preferred Examples thereof are shown below.

The antifogging halogenated compound may be used in combination with an isocyanate compound described in JP-A 6-208193, an aziridine compound described in U.S. Pat. No. 3,017,280 and JP-A 9-5916, and an epoxy compound described in JP-A 10-186561 and 9-5916, thereby enhancing antifogging effects. The combined use of a carbodiimide compound described in U.S. Pat. No. 3,100,704 is also effective, though its effect is less than that of the compounds described above. The antifogging compounds such as the isocyanate or epoxy compound is used preferably in an amount of 0.002 to 2 mol, and more preferably 0.03 to 0.3 mol per mol of silver.

In cases where the thermally developable photosensitive material is specifically employed for the output of a printing image setter with an oscillation wavelength of 600 to 800 nm, hydrazine derivatives are preferably incorporated into the photosensitive material. Exemplary preferred hydrazine compounds are described in RD23515 (November, 1983, page 346), U.S. Pat. Nos. 4,080,207, 4,269,929, 4,276,364, 4,278,748, 4,385,108, 4,459,347, 4,478,928, 4,560,638, 4,686,167, 4,912,016, 4,988,604, 4,994,365, 5,041,355, and 5,104,769; British Patent 2,011,391B; European Patents 217,310, 301,799 and 356,898; JP-A 60-179734, 61-170733, 61-270744, 62-178246, 62-270948, 63-29751, 63-32538, 63-104047, 63-121838, 63-129337, 63-22374, 63-234244, 63-234245, 63-234246, 63-294552, 63-306438, 64-10233, 1-90439, 1-100530, 1-105041, 1-105943, 1-276128, 1-280747, 1-283548, 1-283549, 1-285940, 2-2541, 2-7057, 2-13958, 2-196234, 2-196235, 2-198440, 2-198441, 2-198442, 2-220042, 2-221953, 2-221954, 2-285342, 2-285343, 2-289843, 2-302750, 2-304550, 3-37642, 3-54549, 3-125134, 3-184039, 3-240036, 3-240037, 3-259240, 3-280038, 3-282536, 4-51143, 4-56842, 4-84134, 2-230233, 4-96053, 4-216544, 5-45761, 5-45762, 5-45763, 5-45764, 5-45765, 6-289524, and 9-160164. Furthermore, other than those, employed can be compounds described in (Ka 1) of Japanese Patent Publication (hereinafter, denoted as JP-B) No. 6-77138, specifically, compounds described on pages 3 and 4 of the Publication; compounds represented by general formula (I) in JP-B No. 6-93082, specifically, compounds 1 through 38 described on pages 8 to 18 of the Publication; compounds represented by general formula (4), general formula (5), and general formula (6) in JP-A No. 6–230497, specifically, compounds 4-1 through 4–10 on pages 25 and 26, compounds 5-1 through 5-42 on pages 28 to 36, and compounds 6-1 through 6-7 on pages 39 and 40 of the Publication; compounds represented by general formula (I) and general formula (2) in JP-A No. 6-289520, specifically, compounds 1—1) through 1–17) and 2–1) on pages S to 7 of the Publication; compounds described in (Ka 2) and (Ka 3) of JP-A No. 6-313936, specifically, compounds described on pages 6 to 19 of the Publication; compounds described in (Ka 1) of JP-A No. 6-313951, specifically, compounds described on pages 3 to 5 of the Publication; compounds represented by general formula (I) in JP-A No. 7-5610, specifically, compounds I-1 through I-38 described on pages 5 to 10 of the Publication; compounds represented by general formula (II) in JP-A No. 7-77783, specifically, compounds II-1 through II-102 described on pages 10 to 27 of the Publication; and compounds represented by general formula (H) and general formula (Ha) in JP-A No. 7-104426, specifically, compounds H-1 through H-44 described on pages 8 to 15 of the Publication.

In the present invention, a matting agent is preferably incorporated into the image forming layer side. In order to minimize the image abrasion after thermal development, the matting agent is provided on the surface of a photosensitive material and the matting agent is preferably incorporated in an amount of 0.5 to 30 per cent in weight ratio with respect to the total binder in the emulsion layer side.

In cases where a light-insensitive layer is provided on the opposite side of the support to the light-sensitive layer, it is preferred to incorporate a matting agent into at least one of the light-insensitive layer (and more preferably, into the surface layer) in an amount of 0.5 to 40% by weight, based on the total binder on the opposite side to the photosensitive layer.

Materials of the matting agents employed in the present invention may be either organic substances or inorganic substances. Examples-of the inorganic substances include silica described in Swiss Patent No. 330,158, etc.; glass powder described in French Patent No. 1,296,995, etc.; and carbonates of alkali earth metals or cadmium, zinc, etc. described in U.K. Patent No. 1.173,181, etc. Examples of the organic substances include starch described in U.S. Pat. No. 2,322,037, etc.; starch derivatives described in Belgian Patent No. 625,451, U.K. Patent No. 981,198, etc.; polyvinyl alcohols described in Japanese Patent Publication No. 44-3643, etc.; polystyrenes or polymethacrylates described in Swiss Patent No. 330,158, etc.; polyacrylonitriles described in U.S. Pat. No. 3,079,257, etc.; and polycarbonates described in U.S. Pat. No. 3,022,169.

The shape of the matting agent may be crystalline or amorphous. However, a crystalline and spherical shape is preferably employed. The size of a matting agent is expressed in the diameter of a sphere having the same volume as the matting agent. The particle diameter of the matting agent in the present invention is referred to the diameter of a spherical converted volume. The matting agent employed in the present invention preferably has an average particle diameter of 0.5 to 10 $\mu$m, and more preferably of 1.0 to 8.0 $\mu$m. Furthermore, the variation coefficient of the size distribution is preferably not more than 50 percent, is more preferably not more than 40 percent, and is most preferably not more than 30 percent. The variation coefficient of the size distribution as described herein is a value represented by the formula described below:

(Standard deviation of particle diameter)/(average particle diameter)×100

The matting agent according to the present invention can be incorporated into any layer. In order to accomplish the object of the present invention, the matting agent is preferably incorporated into the layer other than the photosensitive layer layer, and is more preferably incorporated into the farthest layer from the support. Addition methods of the matting agent include those in which a matting agent is previously dispersed into a coating composition and is then coated, and prior to the completion of drying, a matting agent is sprayed. When plural matting agents are added, both methods may be employed in combination.

In cases where the thermally developable photosensitive material is specifically employed for the output of a printing image setter with an oscillation wavelength of 600 to 800 nm, hydrazine derivatives are preferably incorporated into the photosensitive material. Exemplary preferred hydrazine compounds are described in RD23515 (November, 1983, page 346), U.S. Pat. Nos. 4,080,207, 4,269,929, 4,276,364, 4,278,748, 4,385,108, 4,459,347, 4,478,928, 4,560,638, 4,686,167, 4,912,016, 4,988,604, 4,994,365, 5,041,355, and 5,104,769; British Patent 2,011,391B; European Patents 217,310, 301,799 and 356,898; JP-A 60-179734, 61-170733, 61-270744, 62-178246, 62-270948, 63-29751, 63-32538, 63-104047, 63-121838, 63-129337, 63-22374, 63-234244, 63-234245, 63-234246, 63-294552, 63-306438, 64-10233, 1-90439, 1-100530, 1-105041, 1-105943, 1-276128, 1-280747, 1-283548, 1-283549, 1-285940, 2-2541, 2-7057, 2-13958, 2-196234, 2-196235, 2-198440, 2-198441,2-198442, 2-220042, 2-221953, 2-221954, 2-285342, 2-285343, 2-289843, 2-302750, 2-304550, 3-37642, 3-54549, 3-125134, 3-184039, 3-240036, 3-240037, 3-259240, 3-280038, 3-282536, 4-51143, 4-56842, 4-84134, 2-230233, 4-96053, 4-216544, 5-45761, 5-9;45762, 5-45763, 5-45764, 5-45765, 6-289524, and 9-160164.

Furthermore, other than those, employed can be compounds described in (Ka 1) of Japanese Patent Publication (hereinafter, denoted as JP-B 6-77138, specifically, compounds described on pages 3 and 4 of the Publication; compounds represented by general formula (I) in JP-B 6-93082, specifically, compounds 1 through 38 described on pages 8 to 18 of the Publication; compounds represented by general formula (4), general formula (5), and general formula (6) in JP-A No. 6-230497, specifically, compounds 4-1 through 4-10 on pages 25 and 26, compounds 5-1 through 5-42 on pages 28 to 36, and compounds 6-1 through 6-7 on pages 39 and 40 of the Publication; compounds represented by general formula (I) and general formula (2) in JP-A 6-289520, specifically, compounds 1-1) through 1-17) and 2-1) on pages 5 to 7 of the Publication; compounds described in (Ka 2) and (Ka 3) of JP-A 6-313936, specifically, compounds described on pages 6 to 19 of the Publication; compounds described in (Ka 1) of JP-A 6-313951, specifically, compounds described on pages 3 to 5 of the Publication; compounds represented by general formula (I) in JP-A No. 7-5610, specifically, compounds I-1 through I-38 described on pages 5 to 10 of the Publication; compounds represented by general formula (II) in JP-A 7-77783, specifically, compounds II-1 through II-102 described on pages 10 to 27 of the Publication; and compounds represented by general formula (H) and general formula (Ha) in JP-A 7-104426, specifically, compounds H-1 through H-44 described on pages 8 to 15 of the, Publication.

The thermally developable photothermographic material according to the invention comprises a support having thereon a photosensitive layer, and preferably further on the photosensitive layer having a light-insensitive layer. For example, it is preferred that a protective layer is provided on the light-sensitive layer to protect the light-sensitive layer and that a back coating layer is provided on the opposite side of the support to the light-sensitive layer to prevent adhesion between photosensitive materials or sticking of the photosensitive material to a roller. Further, there may be provided a filter layer on the same side or opposite side to the photosensitive layer to control the amount or wavelengths of light transmitting the thermally developable photosensitive layer. Alternatively, a dye or pigment may be incorporated into the photosensitive layer. In this case, dyes described in JP-A 8-201959 are preferably used therein. The photosensitive layer may be comprised of plural layers. To adjust contrast, a high speed layer and low speed layer may be provided in combination. Various adjuvants may be incorporated into the light-sensitive layer, light-insensitive layer or other component layer(s). There may be employed a surfactant, antioxidant, stabilizer, plasticizer, UV absorbent, and coating aid in the photothermographic materials.

Any light source within the infrared region is applicable to exposure of the thermally developable photosensitive material, and Kr laser or infrared semiconductor lasers (780 nm, 820 nm) are preferred in terms of high power and transmission capability through the photosensitive material.

In the invention, exposure is preferably conducted by laser scanning exposure. It is also preferred to use a laser exposure apparatus, in which a scanning laser light is not exposed at an angle substantially vertical to the exposed surface of the photosensitive material. The expression "laser light is not exposed at an angle substantially vertical to the exposed surface" means that laser light is exposed preferably at an angle of 55 to 88°, more preferably 60 to 86°, still more preferably 65 to 84°, and optimally 70 to 82°. When the photosensitive material is scanned with laser light, the beam spot diameter on the surface of the photosensitive material is preferably not more than 200 μm, and more preferably not more than 100 μm. Thus, a smaller spot diameter preferably reduces the angle displacing from verticality of the laser incident angle. The lower limit of the beam spot diameter is 10 μm. The thus laser scanning exposure can reduce deterioration in image quality due to reflected light, resulting in occurrence such as interference fringe-like unevenness.

Exposure applicable in the invention is conducted preferably using a laser scanning exposure apparatus producing longitudinally multiple scanning laser beams, whereby deterioration in image quality such as occurrence of interference fringe-like unevenness is reduced, as compared to a scanning laser beam of the longitudinally single mode. Longitudinal multiplication can be achieved by a technique of employing backing light with composing waves or a technique of high frequency overlapping. The expression "longitudinally multiple" means that the exposure wavelength is not a single wavelength. The exposure wavelength distribution is usually not less than 5 nm and not more than 10 nm. The upper limit of the exposure wavelength distribution is not specifically limited but is usually about 60 nm.

The thermally developable photosensitive material, which is stable at ordinary temperatures, is exposed and heated at a high temperature (preferably 80 to 200° C., and more preferably 100 to 150° C.) to undergo development. In cases when heated at a temperature of lower than 80° C., sufficient image density can be obtained within a short time. Further, in cases when heated at a temperature of higher than 200° C., a hinder melts and is transferred to a roller, adversely affecting not only images but also transportability and a developing machine. The organic silver salt (functioning as an oxidant) and the reducing agent undergo oxidation-reduction reaction upon heating to form silver images. The reaction process proceeds without supplying any processing solution such as water. The moisture is preferably 0.01 to 5.0% by weight immediately before thermal processing. The higher moisture content tends to increase fogging, and the commercially-acceptable upper limit thereof is contemplated to be 5.0% by weight.

EXAMPLES

The present invention will be further described based on examples but embodiments of the invention are by no means limited to these examples.

Example 1

Preparation of a Subbed PET Photographic Support

Both surfaces of a biaxially stretched thermally fixed 100 μm PET film, available on the market, was subjected to corona discharging at 8 w/m$^2$·min. Onto the surface of one side, the subbing coating composition a-1 described below was applied so as to form a dried layer thickness of 0.8 μm, which was then dried. The resulting coating was designated Subbing Layer A-1. Onto the opposite surface, the subbing coating composition b-1 described below was applied to form a dried layer thickness of 0.8 μm. The resulting coating was designated Subbing Layer B-1.

Subbing Coating Composition a-1

| | |
|---|---|
| Latex solution (solid 30%) of a copolymer consisting of butyl acrylate (30 weight %), t-butyl acrylate (20 weight %) styrene (25 weight %) and 2-hydroxy ethyl acrylate (25 weight %) | 270 g |
| (C-1) | 0.6 g |
| Hexamethylene-1,6-bis(ethyleneurea) | 0.8 g |
| Water to make | 1 liter |

Subbing Coating Composition b-1

| | |
|---|---|
| Latex liquid (solid portion of 30%) of a copolymer consisting of butyl acrylate (40 weight %) styrene (20 weight %) glycidyl acrylate (25 weight %) | 270 g |
| (C-1) | 0.6 g |
| Hexamethylene-1,6-bis(ethyleneurea) | 0.8 g |
| Water to make | 1 liter |

Subsequently, the surfaces of Subbing Layers A-1 and B-1 were subjected to corona discharging with 8 w/m$^2$·minute. Onto the Subbing Layer A-1, the upper subbing layer coating composition a-2 described below was applied so as to form a dried layer thickness of 0.8 μm, which was designated Subbing Layer A-2, while onto the Subbing Layer B-1, the upper subbing layer coating composition b-2 was applied so at to form a dried layer thickness of 0.8 μm, having a static preventing function, which was designated Subbing Upper Layer B-2.

Upper Subbing Layer Coating Composition a-2

| | |
|---|---|
| Gelatin in an amount (weight) to make | 0.4 g/m$^2$ |
| (C-1) | 0.2 g |
| (C-2) | 0.2 g |
| (C-3) | 0.1 g |
| Silica particles (av. size 3 μm) | 0.1 g |
| Water to make | 1 liter |

Upper Subbing Layer Coating Composition b-2

| | |
|---|---|
| (C-4) | 60 g |
| Latex solution (solid 20% comprising) (C-5) as a substituent | 80 g |
| Ammonium sulfate | 0.5 g |
| (C-6) | 12 g |
| Polyethylene glycol (average molecular weight of 600) | 6 g |
| Water to make | 1 liter |

(C-1)

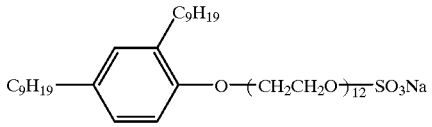

(C-2)

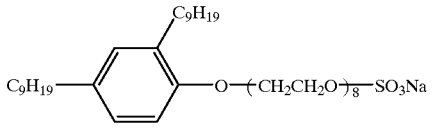

(C-3)

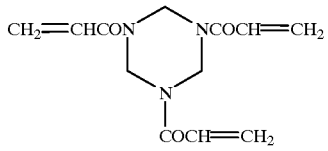

(C-4)

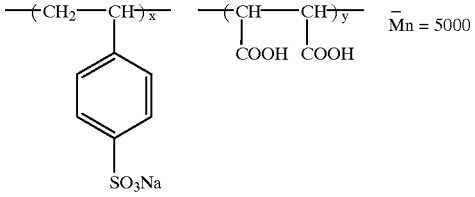

($\bar{M}n$ is a number average molecular weight)
$x$:$y$ = 75:25 (weight ratio)

(C-5)

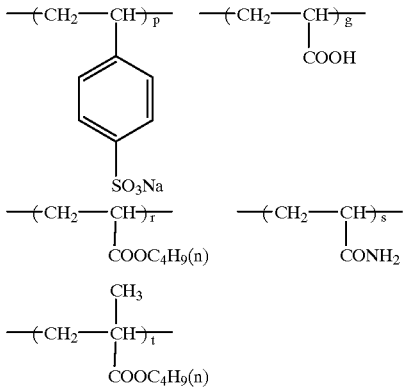

$p$:$g$:$r$:$s$:$t$: = 40:5:10:5:40 (weight ratio)

-continued

C-6

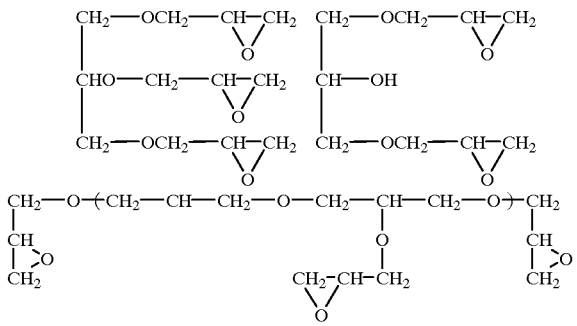

Mixture consisting of the three compounds illustrated above

Thermal Treatment of Support

The subbed support was dried at 140° C. in the process of subbing and drying a support.

Preparation of Back Coat Composition

To 35 g of ethyl acetate, 2.5 g of Dye-1 and 7.5 g of Dye-adjusting agent 1 were added and dissolved with stirring. Further thereto, 50 g of an aqueous 10 wt % polyvinyl alcohol solution was added and stirred with a homogenizer. Thereafter, ethyl acetate was distilled out and the mixture was diluted with water to prepare a colorant dispersion. Then, 50 g of the thus prepared colorant dispersion, 20 g of Dye-adjusting agent 2, 250 g water and 1.8 g of Sildex H121 (silica spherical particles having an average size of 12 $\mu$m, available from DOKAI KAGAKU Corp.), each per 30 g of polyvinyl alcohol, were added thereto to prepare a back coat composition.

Coating of Backing Layer

The thus prepared coating composition for a backing layer was coated on upper sublayer B-2 by an extrusion coater and dried so as to have dry thickness of 3.5 $\mu$m and dried at a dry-bulb temperature of 100° C. and a wet-bulb temperature of 10° C. over a period of 5 min.

Preparation of Light-sensitive Silver Halide Emulsion a

In 900 m1 of deionized water were dissolved 7.5 g of gelatin having an average molecular weight of 100,000 and 10 mg of potassium bromide. After adjusting the temperature and the pH to 35° C. and 3.0, respectively, 370 m1 of an aqueous solution containing 74 g silver nitrate and an equimolar aqueous solution containing potassium bromide, potassium iodide (in a molar ratio of 98 to 2) and $1\times10^{-4}$ mol/mol Ag of iridium chloride were added over a period of 10 minutes by the controlled double-jet method, while the pAg was maintained at 7.7. Thereafter, 4-hydroxy-6-methyl-1,3,3a,7-tetraazaindene was added and the pH was adjusted to 5 using NaOH. There was obtained cubic silver iodobromide grains having an average grain size of 0.06 $\mu$m, a variation coefficient of the projection area equivalent diameter of 10 percent, and the proportion of the {100}face of 87 percent. The resulting emulsion was flocculated to remove soluble salts, employing a flocculating agent and after desalting, 0.1 g of phenoxyethanol was added and the pH and pAg were adjusted to 5.9 and 7.5, respectively to obtain silver halide emulsion a. The thus obtained light-sensitive emulsion grains were measured with respect to the average iodide content in the vicinity of the grain surface and it was proved to be 4.0 mol %. Then, temperature was raised to 40° C., and 350 mg of sensitizing dye Dye-C, 4.65 g of 2-chlorobenzoic acid, 19.30 g of benzoic acid and 2.14 g of 5-methyl-2-mercaptobenzimidazole were dissolved in 73.4 ml of methanol in the darkroom. The thus prepared sensitizing dye solution was added to the emulsion as prepared above, in an amount of $5\times10^{-4}$ mol/mol AgX, stirred for 30 min. and rapidly cooled to 25° C. to obtain light-sensitive silver halide emulsion a.

Antifoggant 1

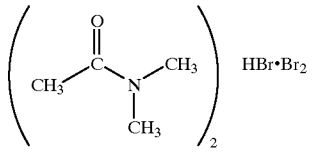

Sensitizing dye Dye -C

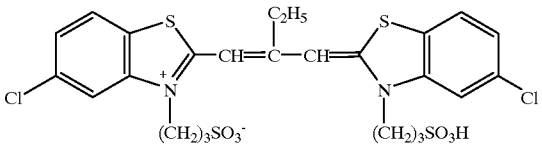

Surfactant A

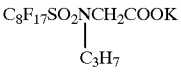

Surfactant B

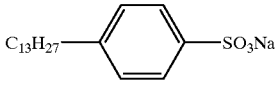

Dye -1

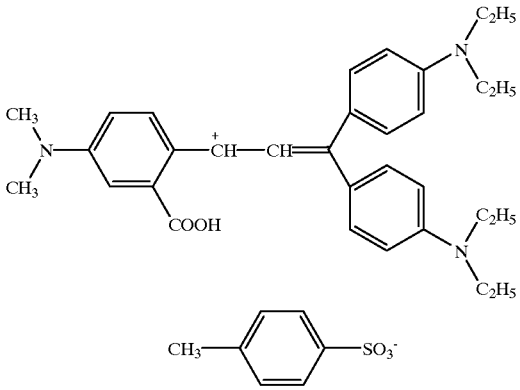

Dye-adjusting agent 1

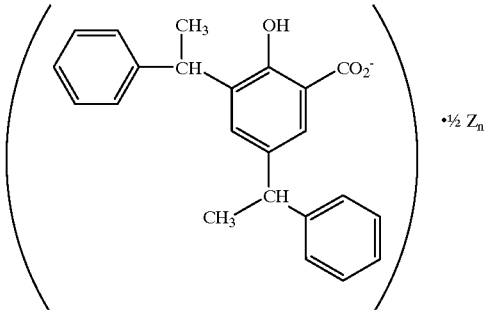

Dye-adjusting agent 2

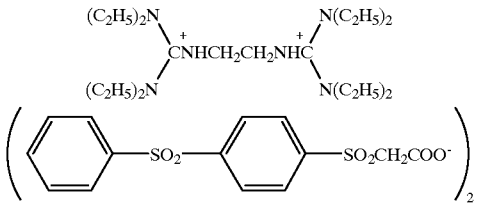

Preparation of Organic Silver Salt Dispersion 1

In 4720 ml water at 80° C. were dissolved 111.4 g of behenic acid, 83.8 g of arachidic acid and 54.9 g of stearic acid. Further thereto was added 540.2 ml of aqueous 1.5M sodium hydroxide solution with stirring at a high-speed and after adding 6.9 ml of concentrated nitric acid, the mixture was cooled to 55° C. to obtain an aqueous fatty acid sodium salt solution. Then, 450 ml water was added thereto, 760.6 ml of aqueous 1M silver nitrate solution was added in 2 min., and after stirring for 20 min., the reaction mixture was filtered to remove soluble salts and washed with deionized water until the filtrate reached a conductivity of 2 μS/cm. The thus obtained solid product was treated in the form of wet cake, without being dried and 12 g of polyvinyl alcohol and 150 m1 water, each per 34.8 g of the solid product, were added with stirring to obtain slurry. The obtained slurry was added into a vessel together with 840 g of zirconia beads of 0.5 mm in diameter and dispersed by means of a dispersing machine (1/4G sand grinder mill, available from Imex Co. Ltd.) for a period of 5 hr. to obtain an organic silver salt dispersion 1. As a result of microscopic observation, the dispersion was comprised of needle-like, microcrystals having an average particle size of 0.04 μm, an average long diameter of 0.8 μm and a variation coefficient of particle size distribution, based on projected area, of 30%.

Preparation of Light-sensitive Layer Composition

To 500 g of polymeric latex, Laxter 3307B (available from DAINIPPON INK Co. Ltd.) was added the prepared organic silver salt dispersion (equivalent to 1 mole, based on silver) and the following additives were added thereto to prepare an emulsified coating solution, while being sufficiently stirred at a temperature of 21° C., in which a light-sensitive silver halide emulsion a was represented by equivalent converted to silver. The additives each were prepared in advance according to the following manner. Thus, each of the additives was optimally obtained in the form of a solid particle dispersion, in which 70 wt % was accounted for by particles of 0.1 μm in diameter. In the case of tetrachlorophthalic acid, for example, hydroxypropylmethylphenylsulfon was stirred with water to form slurry; after being allowed to stand for 12 hr., the slurry was added into a vessel together with 100 g of zirconia beads of an average size of 0.5 mm and dispersed by a dispersing machine for 6 hr. to obtain a solid particle dispersion.

| | |
|---|---|
| Antifoggant 1 | 9.0 g |
| Calcium bromide dihydrate | 6.0 g |
| Silver halide emulsion a, equivalent to 5 mol % of silver of organic silver salt | |
| Developer [1,1-bis(2-hydroxy-3,5-dimethylphenyl)-2-methylpropane] | 15 g |
| Desmodu N3300 (aliphatic isocyanate, available from Movey Corp.) | 1.10 g |
| Phthalazine | 1.5 g |
| Tetrachlorophthalic acid | 0.5 g |
| 4-Methylphthalic acid | 0.5 g |

Laxter 3307B was a latex of styrene-butadiene copolymer, in which an average size of dispersed particles was 0.1 to 0.15 pm and the equilibrium moisture content was 0.6%. The moisture content was determined in the following manner.

Equilibrium Moisture Content

A polymer solution (or dispersion) was coated on a glass plate and dried at 50° C. for 1 hr. to obtain a polymer model membrane of ca. 100 μm thick. The thus obtained polymer model membrane was peeled off from the glass plate and after being allowed to stand in an atmosphere at 25° C. and 60% RH for a period of 3 days, the weight thereof ($W_1$) was measured. Separately, after being allowed to stand in vacuo at 25° C. for 3 days, the membrane was weighed in a weighing bottle ($W_0=W_3-W_2$, in which W3 was weight of polymer model membrane and a weighing bottle, and $W_2$ was a weight of the weighing bottle). From $W_0$ and $W_1$, the moisture content at 25° C. and 60% RH was determined according to the following equation:

$$\text{Equilibrium moisture content}=\{(W_1-W_0)/W_0\}\times 100$$

Preparation of Surface Protective Layer Coating Composition

To 10 g of inert gelatin, 0.26 g of surfactant A, 0.09 g of surfactant B, 0.9 g of fine silica particles, 0.3 g of 1,2-(bisvinylsulfonylacetoamido)ethane and 64 g of water were added to prepare a coating composition for a surface protective layer.

Coating of Light-sensitive Layer and Protective Layer

The prepared coating composition for the light-sensitive layer was maintained at a temperature of 13° C. and coated according to the following procedure to obtain Sample 1. Samples 2 through 24 were also prepared similarly to Sample 1, except that sensitizing dyes and macrocyclic compounds were varied as shown in Table 1. In this case, the macrocyclic compound was added prior to addition of the sensitizing dye. Thus, the light-sensitive layer coating composition and the protective layer coating composition described above were simultaneously coated by means of an extrusion coater at a speed of 20 m/min so that the silver coverage of the photosensitive layer was 2.0 g/m$^2$ and dry thickness of the protective layer was 2.5 μm. Thereafter, drying was conducted using hot-air at a dry-bulb temperature of 75° C. and a wet-bulb temperature of 10° C. over a period of 10 min.

Exposure and Development

The thus prepared photothermographic material samples each were cut to a size of 3.5 cm x 15 cm and allowed to stand under the following condition (A) or (B):

(A) at 23° C. and 55% RH, and for 24 hrs. and (B) at 55° C. and 55% RH

Thereafter, aged samples were each subjected to laser scanning exposure from the emulsion side using an exposure apparatus having a light source of 800 to 820 nm semiconductor laser of longitudinal multi-mode, which was made by means of high frequency overlapping. In this case, exposure was conducted at an angle between the exposed surface and exposing laser light was 750 and in an atmosphere at a temperature of 23° C. and 50% RH (and as a result, images with superior sharpness were unexpectedly obtained, as compared to exposure at an angle of 90°). Using an automatic processor provided with a heated drum, thereafter, exposed samples were subjected to thermal development at 110° C. for 15 sec., while bringing the protective layer surface of the photothermographic material into contact with the drum surface. The thermal development was conducted in an atmosphere at 23° C. and 50% RH. Thermally developed samples each were subjected to sensitometry using a densitometer and evaluated with respect to a fog density (i.e., minimum density, denoted as Dmin) and sensitivity. The sensitivity was represented by a relative value of reciprocal of exposure necessary to give a density of Dmin plus 1.0, based on the sensitivity of Sample 1 being 100. Results thereof are shown in Table 1.

Evaluation of Light Stability and Heat Stability

Further, photothermographic material samples were evaluated with light stability and heat stability. Thus, sample were aged under the condition (A) and thermally developed similarly as described above. The thus developed samples were allowed to stand under the following condition (C) or (E):

(C) aged at 23° C. and 55% RH for 1 day, (D) aged for 20 hrs., while the light-sensitive layer side of each sample was exposed under the light source of 10,000 lux (fluorescent lamp), and (E) aged at 55° C. and 75% RH for 7 days.

Minimum densities of samples aged under the conditions (C), (D) and (E) were measured, which were respectively denoted as Dmin(C), Dmin(D) and Dmin(E). Light stability and heat stability were each evaluated, based on the following relationship:

Light stability=Dmin(D) minus Dmin(C)

Heat stability=Dmin(E) minus Dmin(C).

Results there of are also shown in Table 1.

As can be seen from Table 1, it was proved that the use of sensitizing dyes according to the invention in combination with nitrogen containing macrocyclic compound led to enhanced sensitivity and improved storage stability, and synergetic effects by the combined use were apparent.

Example 2

Silver halide emulsions b, c and d were prepared in a manner similar to silver halide emulsion a of Example 1, except that the overall iodide content of the grain was varied by varying the amounts of KBr and KI to be added in the grain formation, as shown in Table 2. Photothermographic material Samples 25 through 27 were prepared in a manner similar to Sample 17 in Example 1, except that silver halide emulsion a was replaced by emulsion b, c or d. Sample 28 through 30 were prepared similarly to Sample 18 in Example 1. The thus obtained sample were evaluated and results thereof are shown in Table 2.

TABLE 1

| Sample | Sensitizing | Macro-cyclic | Aging A | | Aging B | | Light | Heat | Silver | |
|---|---|---|---|---|---|---|---|---|---|---|
| No. | Dye | Compd. | Dmin | S | Dmin | S | Stability | Stability | Tone | Remark |
| 1 | Dye-C | — | 0.25 | 100 | 0.31 | 64 | 0.020 | 0.030 | C | Comp. |
| 2 | Dye-C | S-19 | 0.25 | 116 | 0.33 | 83 | 0.013 | 0.022 | B | Inv. |
| 3 | Dye-C | S-27 | 0.26 | 112 | 0.35 | 82 | 0.014 | 0.023 | B | Inv. |
| 4 | Dye-C | S-35 | 0.26 | 112 | 0.34 | 83 | 0.013 | 0.023 | B | Inv. |
| 5 | D-16 | — | 0.22 | 121 | 0.26 | 96 | 0.018 | 0.033 | B | Comp. |
| 6 | D-16 | S-19 | 0.22 | 159 | 0.26 | 152 | 0.014 | 0.023 | A | Inv. |
| 7 | D-16 | S-27 | 0.22 | 154 | 0.27 | 150 | 0.015 | 0.025 | A | Inv. |
| 8 | D-16 | S-35 | 0.23 | 153 | 0.28 | 145 | 0.013 | 0.024 | A | Inv. |
| 9 | D-19 | — | 0.23 | 109 | 0.27 | 85 | 0.019 | 0.033 | B | Comp. |
| 10 | D-19 | S-19 | 0.23 | 150 | 0.27 | 141 | 0.015 | 0.024 | A | Inv. |
| 11 | D-19 | S-27 | 0.23 | 144 | 0.27 | 139 | 0.015 | 0.025 | A | Inv. |
| 12 | D-19 | S-35 | 0.24 | 141 | 0.28 | 140 | 0.015 | 0.025 | A | Inv. |
| 13 | D-24 | — | 0.23 | 114 | 0.27 | 88 | 0.019 | 0.035 | B | Comp. |
| 14 | D-24 | S-19 | 0.23 | 155 | 0.27 | 146 | 0.014 | 0.026 | A | Inv. |
| 15 | D-24 | S-27 | 0.24 | 149 | 0.27 | 142 | 0.015 | 0.026 | A | Inv. |
| 16 | D-24 | S-35 | 0.24 | 144 | 0.27 | 140 | 0.014 | 0.026 | A | Inv. |
| 17 | D-37 | — | 0.22 | 122 | 0.26 | 95 | 0.020 | 0.034 | B | Comp. |
| 18 | D-37 | S-19 | 0.22 | 159 | 0.26 | 153 | 0.013 | 0.025 | A | Inv. |
| 19 | D-37 | S-27 | 0.23 | 152 | 0.27 | 151 | 0.014 | 0.025 | A | Inv. |
| 20 | D-37 | S-35 | 0.23 | 154 | 0.27 | 146 | 0.014 | 0.026 | A | Inv. |
| 21 | D-45 | — | 0.23 | 111 | 0.27 | 89 | 0.019 | 0.034 | B | Comp. |
| 22 | D-45 | S-19 | 0.23 | 148 | 0.27 | 135 | 0.014 | 0.024 | A | Inv. |
| 23 | D-45 | S-27 | 0.23 | 149 | 0.28 | 134 | 0.015 | 0.026 | A | Inv. |
| 24 | D-45 | S-35 | 0.24 | 142 | 0.27 | 132 | 0.014 | 0.026 | A | Inv. |

TABLE 2

| Sample | Sensitizing | Macro-cyclic | | Iodide* | Aging A | | Aging B | | Light | Heat | Silver | |
|---|---|---|---|---|---|---|---|---|---|---|---|---|
| No. | Dye | Compd. | Emulsion | (mol %) | Fog | S | Fog | S | Stability | Stability | Tone | Remark |
| 25 | D-16 | — | b | 0 | 0.22 | 85 | 0.19 | 46 | 0.015 | 0.029 | C | Comp. |
| 5 | D-16 | — | a | 4 | 0.22 | 121 | 0.26 | 96 | 0.018 | 0.033 | B | Comp. |
| 26 | D-16 | — | c | 8 | 0.22 | 131 | 0.31 | 109 | 0.021 | 0.036 | B | Comp. |
| 27 | D-16 | — | d | 12 | 0.18 | 75 | 0.29 | 57 | 0.027 | 0.040 | B | Comp. |
| 28 | D-16 | S-19 | b | 0 | 0.22 | 137 | 0.24 | 125 | 0.012 | 0.021 | B | Inv. |
| 18 | D-16 | S-19 | a | 4 | 0.22 | 159 | 0.26 | 152 | 0.014 | 0.023 | A | Inv. |
| 29 | D-16 | S-19 | c | 8 | 0.22 | 156 | 0.27 | 154 | 0.015 | 0.024 | A | Inv. |
| 30 | D-16 | S-19 | d | 12 | 0.21 | 137 | 0.27 | 136 | 0.016 | 0.027 | A | Inv. |

*Average iodide content in the vicinity of grain surface

As can be seen from Table 2, synergetic effects such as markedly enhanced storage stability and superior silver image tone were unexpectedly obtained in the presence of a macrocyclic compound.

Example 3

Photothermographic material Samples 31 to 33 were prepared in a manner similar to Sample 18 of example 1, except that after, coating, a drying time was varied, exhibiting the solvent content as shown in Table 3. These sample were evaluated similarly to Example 1. Results thereof are shown in Table 3.

TABLE 3

| Sample No. | Moisture Content | Aging-A Fog | S | Light Stability | Heat Stability |
|---|---|---|---|---|---|
| 31 | 0.005 | 0.2 | 139 | 0.012 | 0.020 |
| 6 | 0.1 | 0.22 | 160 | 0.014 | 0.023 |
| 32 | 2.0 | 0.23 | 162 | 0.015 | 0.025 |
| 33 | 20 | 0.26 | 165 | 0.032 | 0.042 |

As can be seen from Table 3, it was proved that the moisture content within the preferred range exhibited enhanced sensitivity and reduced fog.

What is claimed is:

1. A silver halide photothermographic material comprising a light-insensitive organic silver salt and comprising a support having thereon a light-sensitive layer and light-insensitive layer, wherein the light-sensitive layer or the light-insensitive layer comprises a nine or more membered macrocyclic compound, containing a heteroatom selected from nitrogen, oxygen, sulfur, and selenium, and the light-sensitive layer comprising a light-sensitive silver halide and a sensitizing dye exhibiting maximum sensitivity at a wavelength of at least 600 nm.

2. The silver halide photothermographic material of claim 1, wherein said sensitizing dye is represented by the following formula (1), (2) or (3):

formula (1)

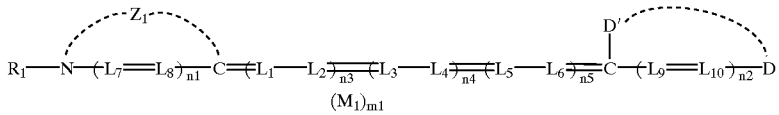

wherein $Z_1$ is an atomic group necessary to form a 5- or 6-membered nitrogen-containing heterocyclic ring; D and D' are each an atomic group necessary to form an acyclic or cyclic acidic nucleus; $R_1$ is an alkyl group; $L_1$, $L_2$, $L_3$, $L_4$, $L_5$, $L_6$, $L_7$, $L_8$, $L_9$ and $L_{10}$ are each a methine group, provided that each may form a ring together with one of the other methine groups or with an auxochrome; n1, n2, n3, n4 and n5 are each 0 or 1; $M_1$ is a counter ion necessary to neutralize charge; and m1 is an integer of 0 or more, which is necessary to counterbalance intramolecular charge;

formula (2)

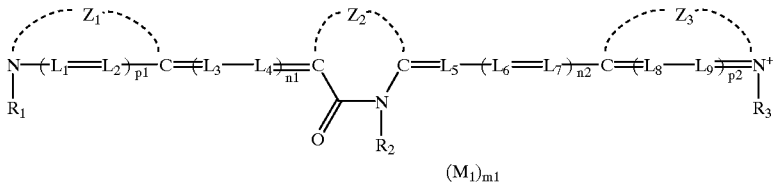

wherein $Z_1$, $Z_2$ and $Z_3$ are each an atomic group necessary to form a 5- or 6-membered nitrogen-containing heterocyclic ring; $R_1$ and $R_3$ are each an alkyl group; $R_2$ is a hydrogen atom, an alkyl group, an aryl group or a heterocyclic group; $L_1$, $L_2$, $L_3$, $L_4$, $L_5$, $L_6$, $L_7$, $L_8$, and $L_9$ are each a methine group; p1 and p2 are each 0 or 1; n1 and n2 are each 0, 1, 2, 3 or 4; $M_1$ represents a charge balancing counter ion; and m1 is an integer of 0 or more, which is necessary to counterbalance intramolecular charge;

formula (3)

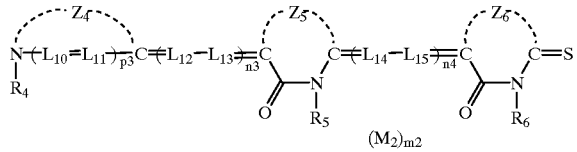

wherein $Z_4$, $Z_5$ and $Z_6$ are each an atomic group necessary to form a 5- or 6-membered nitrogen-containing heterocyclic ring; $R_4$ is an alkyl group; $R_5$ and $R_6$ are each a hydrogen atom, an alkyl group, an aryl group or a heterocyclic group; $L_{10}$, $L_{11}$, $L_{12}$, $L_{13}$, $L_{14}$ and $L_{15}$ are each a methine group; p3 is 0 or 1; n3 and n4 are each 0, 1, 2, 3 or 4; $M_2$ is a charge balancing counter ion; and m2 is an integer of 0 or more, which is necessary to counterbalance intramolecular charge.

3. The silver halide photothermographic material of claim 2, wherein said sensitizing dye represented by formula (2) is represented by the following formula (4):

formula (4)

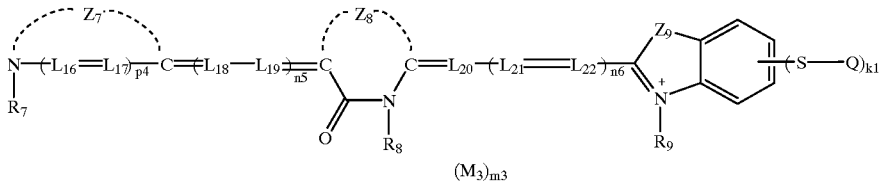

wherein $Z_7$ is the same as defined in $Z_1$ of formula (2), $Z_8$ is the same as defined in $Z_2$ of formula (2) and $Z_9$ is an oxygen atom, a sulfur atom or a selenium atom; $R_7$ is the same as defined in $R_1$ of formula (2), $R_8$ is the same as defined in $R_2$ of formula (2) and $R_9$ is the same as defined in $R_3$ of formula (2); $L_{16}$ is the same as defined in $L_1$ of formula (2), $L_{17}$ is the same as defined in $L_2$ of formula (2), $L_{18}$ is the same as defined in $L_3$ of formula (2), $L_{19}$ is the same as defined in $L_4$ of formula (2), $L_{20}$ is the same as defined in $L_5$ of formula (2), $L_{21}$ is the same as defined in $L_6$ of formula (2), and $L_{22}$ is the same as defined in $L_7$ of formula (2); p4 is the same as defined in p1 of formula (2); n5 is the same as defined in n1 of formula (2) and n6 is the same as defined in n2 of formula (2); $M_3$ is the same as defined in $M_1$ of formula (2); m3 is the same as defined in m1 of formula (2); Q is an alkyl group, an aryl group or a heterocyclic group; k1 is 1, 2, 3 or 4.

4. The silver halide photothermographic material of claim 3, wherein said sensitizing dye represented by formula (4) is represented by the following formula (5):

formula (5)

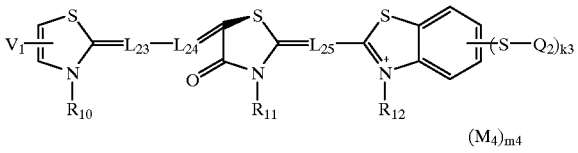

wherein $Q_2$ is the same as defined in Q of formula (4); k3 is the same as defined in k1 of formula (4); $R_{10}$ is the same as defined in $R_1$ of formula (2); $R_{11}$ is the same as defined in $R_2$ of formula (2); $R_{12}$ is the same as defined in $R_3$ of formula (2); $L_{23}$ is the same as defined in $L_3$ of formula (2); $L_{24}$ is the same as defined in $L_4$ of formula (2); $L_{25}$ is the same as defined in $L_5$ of formula (2); MS is the same as defined in $M_1$ of formula (2); m4 is the same as defined in m1 of formula (2); and $V_1$ represents a substituent.

5. The silver halide photothermographic material of claim 1, wherein the light-sensitive layer comprises said sensitizing dye of $1\times10^{-6}$ to $5\times10^{-3}$ mole/AgX mole.

6. The silver halide photothermographic material of claim 1 wherein said macrocyclic compound is a 12- to 24-membered ring compound.

7. The silver halide photothermographic material of claim 1, wherein the light-sensitive layer comprises light-sensitive silver halide having an average iodide content of 0.01 to 10 mol %.

8. The silver halide photothermographic material of claim 7, wherein the light-sensitive layer further comprises an organic silver salt which is comprised of grains having an average size of not more than 2 $\mu$m.

9. The silver halide photothermographic material of claim 8, wherein the total amount of the silver halide and the organic silver salt is 0.5 to 2.2 g in equivalent converted to silver per $m^2$ of the photothermographic material.

10. The silver halide photothermographic material of claim 1, wherein the light-sensitive layer further comprises binder which is mainly comprised of a polymeric latex.

11. The silver halide photothermographic material of claim 10, wherein the ratio by weigh of binder to silver halide is 5 to 400.

12. The silver halide photothermographic material of claim 10, wherein said sensitizing dye is represented by formula (4) or (5):

formula (4)

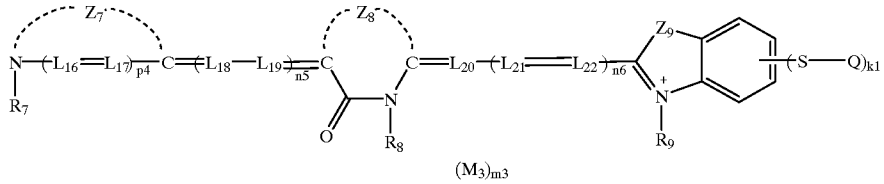

wherein $Z_7$ is the same as defined in $Z_1$ of formula (2), $Z_8$ is the same as defined in $Z_2$ of formula (2) and $Z_9$ is an oxygen atom, a sulfur atom or a selenium atom; $R_7$ is the same as defined in $R_1$ of formula (2), $R_8$ is the same as defined in $R_2$ of formula (2) and $R_9$ is the same as defined in $R_3$ of formula (2); $L_{16}$ is the same as defined in $L_1$ of formula (2), $L_{17}$ is the same as defined in $L_2$ of formula (2), $L_{18}$ is the same as defined in $L_3$ of formula (2), $L_{19}$ is the same as defined in $L_4$ of formula (2), $L_{20}$ is the same as defined in $L_5$ of formula (2), $L_{21}$ is the same as defined in $L_6$ of formula (2), and $L_{22}$ is the same as defined in $L_7$ of formula (2); p4 is the same as defined in p1 of formula (2); n5 is the same as defined in n1 of formula (2) and n6 is the same as defined in n2 of formula (2); $M_3$ is the same as defined in $M_1$ of formula (2); m3 is the same as defined in m1 of formula (2); Q is an alkyl group, an aryl group or a heterocyclic group; k1 is 1, 2, 3 or 4;

formula (5)

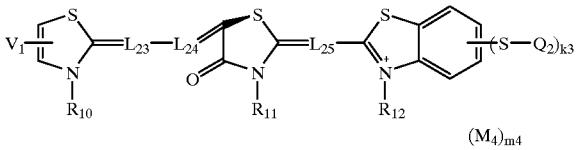

wherein $Q_2$ is the same as defined in Q of formula (4); k3 is the same as defined in k1 of formula (4); $R_{10}$ is the same as defined in $R_1$ of formula (2); $R_{11}$ is the same as defined in $R_2$ of formula (2); $R_{12}$ is the same as defined in $R_3$ of formula (2); $L_{23}$ is the same as defined in $L_3$ of formula (2); $L_{24}$ is the same as defined in $L_4$ of formula (2); $L_{25}$ is the same as defined in $L_5$ of formula (2); $M_4$ is the same as defined in $M_1$ of formula (2); m4 is the same as defined in m1 of formula (2); and $V_1$ represents a substituent.

13. The silver halide photothermographic material of claim 1, wherein said sensitizing dye exhibits maximum sensitivity at a wavelength of 600 to 900nm.

14. The silver halide photothermographic material of claim 10, wherein said polymeric latex is contained in an amount of at least 50% by weight of the total binder contained in the light-sensitive layer.

15. The silver halide photothermographic material of claim 1 wherein said macrocylic compound is a crown ether.

16. The silver halide photothermographic material of claim 1 wherein said macrocyclic compound is selected from

S-1

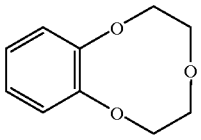

S-2

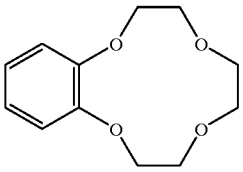

S-3

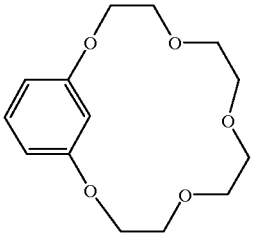

-continued

S-4

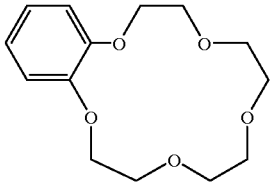

S-5

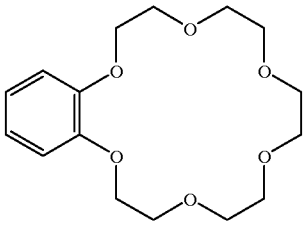

S-6

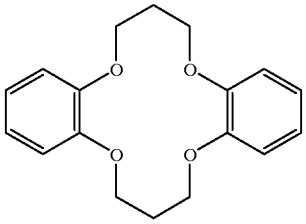

S-7

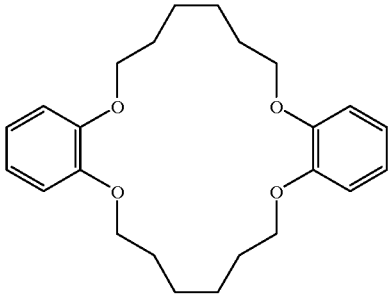

S-8

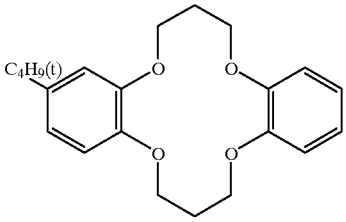

S-9

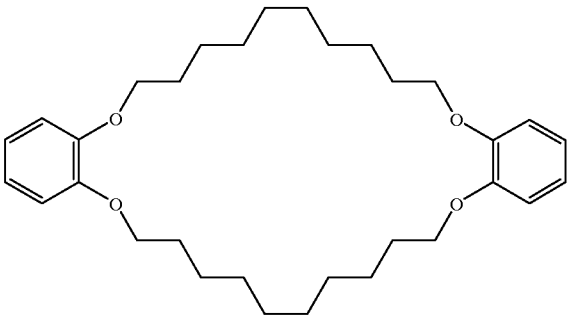

-continued
S-10
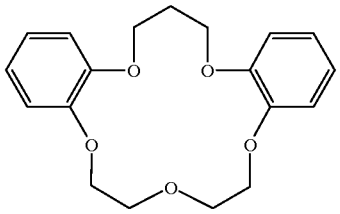
S-11
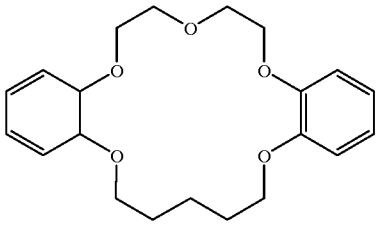
S-12
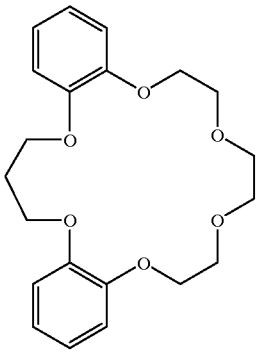
S-13
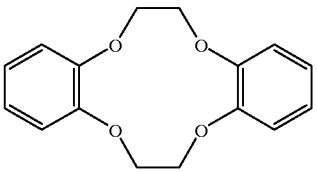
S-14
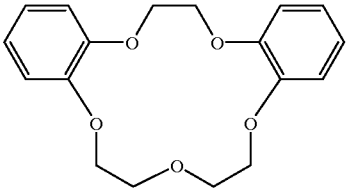
-continued
S-15
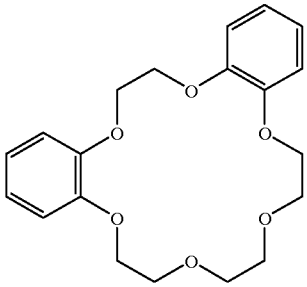
S-16
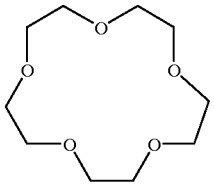
S-17
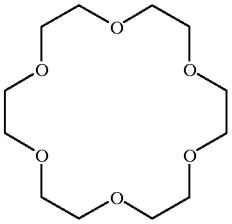
S-18
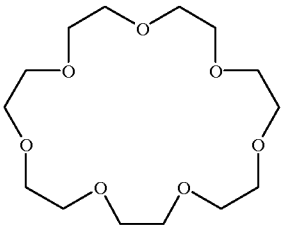
S-19
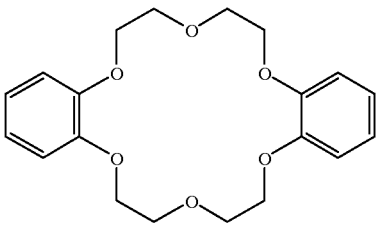

S-20
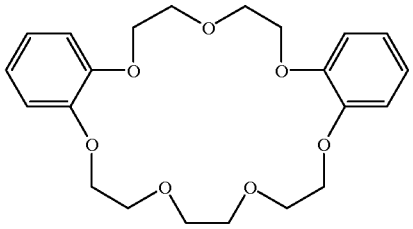
S-21
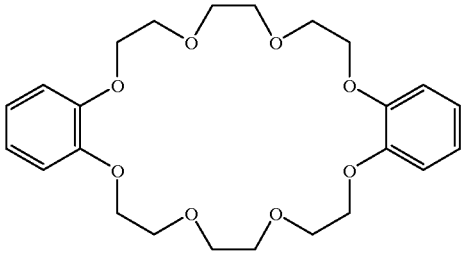
S-22
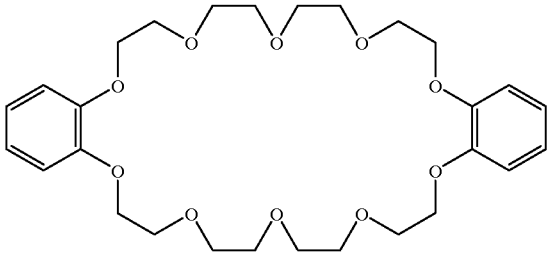
S-23
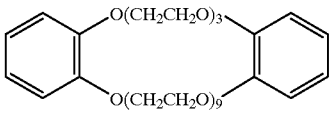
S-24
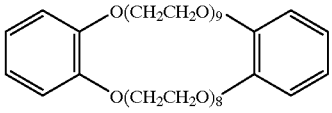
S-25
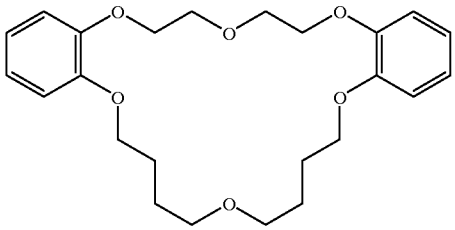
S-26
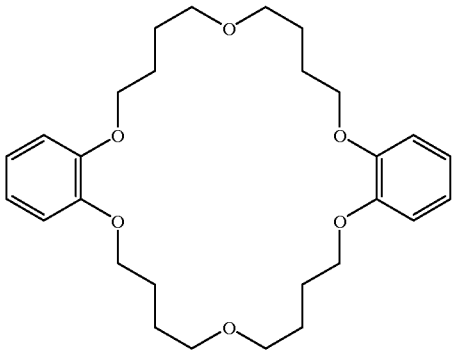
S-27
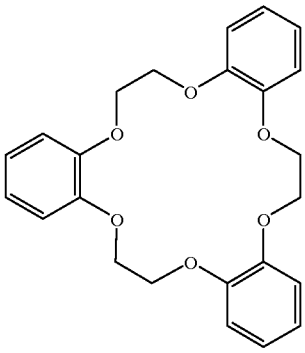
S-28
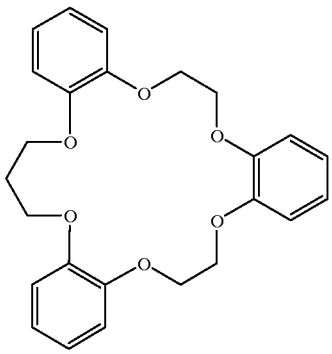

-continued
S-29
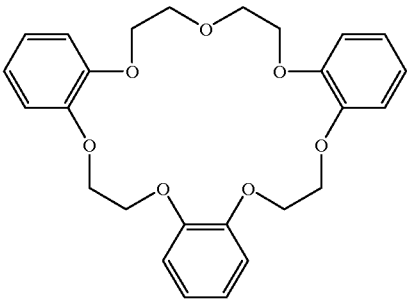
S-30
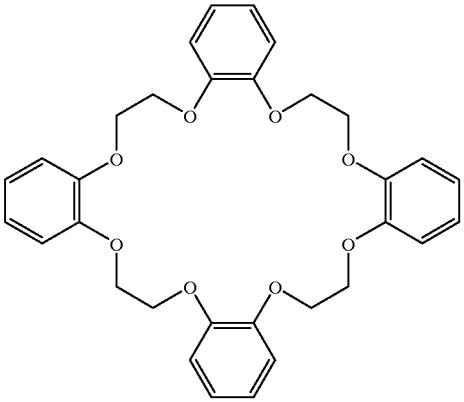
S-31
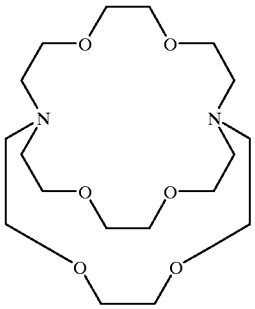
S-32
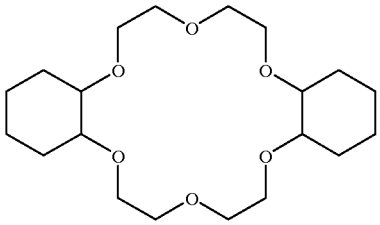
-continued
S-33
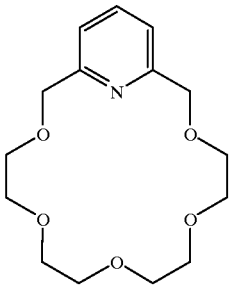
S-34
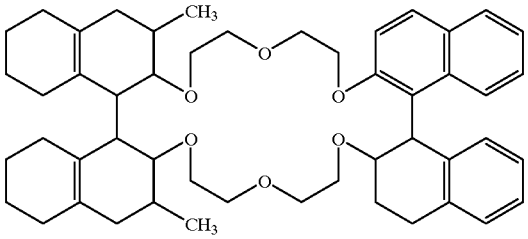
S-35
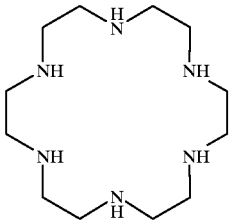
S-36
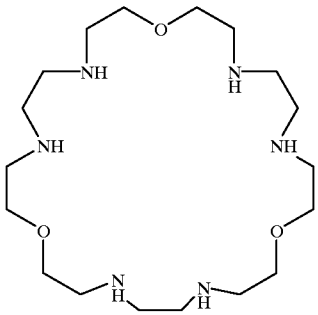

-continued
S-37
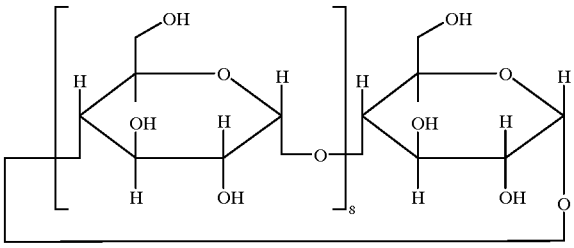
S-38
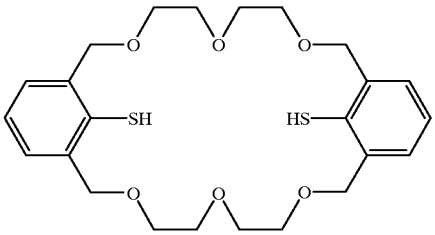
S-39
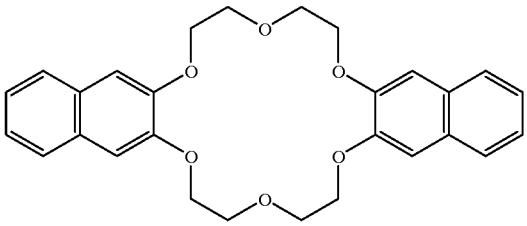
S-40
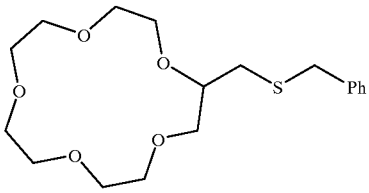
S-41
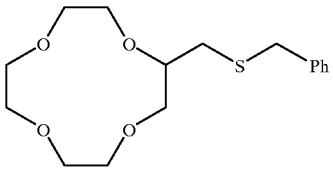
-continued
S-42
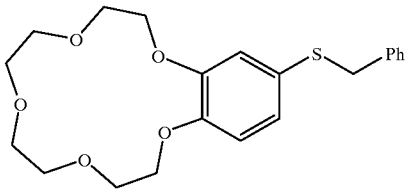
S-43
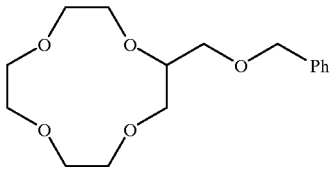
S-44
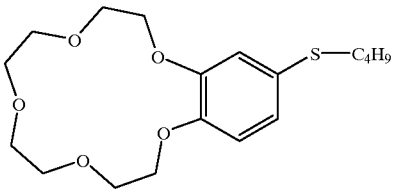
S-45
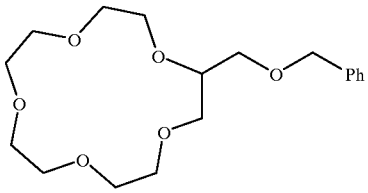
(Ph: phenyl)
* * * * *